US005507493A

United States Patent [19]

Sullivan et al.

[11] Patent Number: 5,507,493

[45] Date of Patent: Apr. 16, 1996

[54] GOLF BALL

[75] Inventors: Michael J. Sullivan, Chicopee; John L. Nealon, Springfield; R. Dennis Nesbitt, Westfield, all of Mass.

[73] Assignee: Lisco, Inc., Tampa, Fla.

[21] Appl. No.: 411,254

[22] Filed: Mar. 27, 1995

Related U.S. Application Data

[63] Continuation-in-part of Ser. No. 171,956, Dec. 22, 1993, which is a continuation of Ser. No. 800,198, Nov. 27, 1991, Pat. No. 5,273,287.

[51] Int. Cl.[6] ..... A63B 37/06; A63B 37/12; A63B 37/14

[52] U.S. Cl. ..... 273/230; 273/232; 273/235 R

[58] Field of Search ..... 273/232, 220, 273/230, 235 R, 231

[56] References Cited

U.S. PATENT DOCUMENTS

| | | | |
|---|---|---|---|
| Re. 25,427 | 7/1963 | Harkins | 273/230 |
| D. 107,066 | 11/1937 | Cavignac | 273/232 |
| D. 228,394 | 9/1973 | Martin et al. | D34/5 QQ |
| D. 243,866 | 3/1977 | Shaw et al. | D34/5 QQ |
| D. 247,685 | 4/1978 | Haines et al. | D34/5 QQ |
| 878,254 | 2/1908 | Taylor | 273/232 |
| 906,932 | 12/1908 | Riblet | 273/233 |
| 922,773 | 5/1909 | Kempshall | 273/232 |
| 985,741 | 2/1911 | Harvey | 273/220 |
| 1,182,605 | 5/1916 | Wadsworth | 273/232 |
| 1,265,036 | 7/1918 | Bendelow | 273/233 |
| 1,286,834 | 12/1918 | Taylor | 273/232 |
| 1,418,220 | 5/1922 | White | 273/232 |
| 1,482,232 | 1/1924 | Hazeltine | 273/232 |
| 1,656,408 | 1/1928 | Young | 273/232 |
| 1,666,699 | 4/1928 | Hagen | 273/232 |
| 1,681,167 | 8/1928 | Beldam | 273/232 |
| 1,716,435 | 6/1929 | Fotheringham | 273/232 |
| 1,855,448 | 4/1932 | Hazeltine | 273/232 |
| 2,002,726 | 5/1935 | Young | 273/62 |
| 2,106,704 | 2/1938 | Davis | 273/62 |
| 2,643,125 | 6/1953 | Juve | 273/235 |
| 2,728,576 | 12/1955 | Martin et al. | 273/232 |
| 2,730,159 | 1/1956 | Semegen | 273/233 |
| 2,741,480 | 4/1956 | Smith | 273/227 |
| 2,861,810 | 11/1958 | Veatch | 273/213 |
| 2,997,302 | 8/1961 | Smith | 273/235 |
| 3,031,194 | 4/1962 | Strayer | 273/213 |
| 3,819,190 | 6/1974 | Nepela et al. | 273/232 |
| 3,940,145 | 2/1976 | Gentiluomo | 273/218 |
| 4,090,716 | 5/1978 | Martin et al. | 273/232 |
| 4,141,559 | 2/1979 | Melvin et al. | 273/220 |
| 4,142,727 | 3/1979 | Shaw | 273/232 |
| 4,201,384 | 5/1980 | Barber | 273/199 R |
| 4,235,441 | 11/1980 | Ciccarello | 273/213 |
| 4,256,304 | 3/1981 | Smith et al. | 273/60 B |
| 4,258,921 | 3/1981 | Worst | 273/232 |
| 4,266,773 | 5/1981 | Treadwell | 273/232 |
| 4,284,276 | 8/1981 | Worst | 273/232 |
| 4,346,898 | 8/1982 | Badke | 273/232 |
| 4,560,168 | 12/1985 | Aoyama | 273/232 |
| 4,653,758 | 3/1987 | Solheim | 273/232 |

(List continued on next page.)

FOREIGN PATENT DOCUMENTS

| | | | |
|---|---|---|---|
| 192618 | 1/1983 | New Zealand . | |
| 4774 | of 1892 | United Kingdom | 273/62 |
| 4360 | of 1898 | United Kingdom | 273/232 |
| 20778 | of 1911 | United Kingdom | 273/232 |
| 22179 | of 1912 | United Kingdom | 273/232 |
| 3012 | of 1912 | United Kingdom | 273/232 |
| 645 | of 1914 | United Kingdom | 273/232 |
| 189551 | 9/1921 | United Kingdom | 273/232 |
| 377354 | 5/1931 | United Kingdom | 273/232 |
| 420410 | 1/1934 | United Kingdom | 273/62 |

*Primary Examiner*—George J. Marlo
*Attorney, Agent, or Firm*—Donald R. Bahr; John E. Benoit

[57] ABSTRACT

A golf ball weighing no more than 1.62 ounces and having a mean outside diameter of at least 1.70 inches. The core compression of the ball and the cover hardness are selected so as to provide a finished ball having a P.G.A. compression of 80 or less and a coefficient of restitution from 0.780 to 0.825. The ball includes a dimple pattern covering at least 70.0 % of the surface of the ball.

10 Claims, 3 Drawing Sheets

U.S. PATENT DOCUMENTS

| | | | |
|---|---|---|---|
| 4,660,834 | 4/1987 | Carrigan | 273/176 AB |
| 4,681,323 | 7/1987 | Alaki et al. | 273/232 |
| 4,720,111 | 1/1988 | Yamada | 273/232 |
| 4,722,529 | 2/1988 | Shaw et al. | 273/232 |
| 4,729,567 | 3/1988 | Oka et al. | 273/232 |
| 4,729,861 | 3/1988 | Lynch et al. | 264/219 |
| 4,744,564 | 5/1988 | Yamada | 273/232 |
| 4,762,326 | 8/1988 | Gobush | 273/232 |
| 4,765,626 | 8/1988 | Gobush | 273/232 |
| 4,772,026 | 9/1988 | Gobush | 273/232 |
| 4,787,638 | 11/1988 | Kobayashi | 273/232 |
| 4,804,189 | 2/1989 | Gobush | 273/232 |
| 4,813,677 | 3/1989 | Oka et al. | 273/232 |
| 4,830,378 | 5/1989 | Aoyama et al. | 273/232 |
| 4,840,381 | 6/1989 | Ihara et al. | 273/232 |
| 4,844,472 | 7/1989 | Ihara | 273/232 |
| 4,848,766 | 7/1989 | Oka et al. | 273/232 |
| 4,858,923 | 8/1989 | Gobush et al. | 273/62 |
| 4,867,459 | 9/1989 | Ihara | 273/232 |
| 4,869,512 | 9/1989 | Nomura et al. | 273/232 |
| 4,877,252 | 10/1989 | Shaw | 273/232 |
| 4,880,241 | 11/1989 | Melvin et al. | 273/232 |
| 4,886,277 | 12/1989 | Mackey | 273/232 |
| 4,915,389 | 4/1990 | Ihara | 273/232 |
| 4,915,390 | 4/1990 | Gobush et al. | 273/232 |
| 4,921,255 | 5/1990 | Taylor | 273/232 |
| 4,925,193 | 5/1990 | Melvin et al. | 273/232 |
| 4,932,664 | 6/1990 | Pocklington et al. | 273/232 |
| 4,936,587 | 6/1990 | Lynch et al. | 273/232 |
| 4,949,976 | 8/1990 | Gobush | 273/232 |
| 4,960,282 | 10/1990 | Shaw | 273/232 |
| 4,960,283 | 10/1990 | Gobush | 273/232 |
| 4,968,038 | 11/1990 | Yamada | 273/232 |
| 4,971,330 | 11/1990 | Morell | 273/232 |
| 4,973,057 | 11/1990 | Morell | 273/232 |
| 4,974,853 | 12/1990 | Morell | 273/232 |
| 4,974,854 | 12/1990 | Morell | 273/232 |
| 4,974,855 | 12/1990 | Morell | 273/232 |
| 4,974,856 | 12/1990 | Morell | 273/232 |
| 4,979,747 | 12/1990 | Jonkouski | 273/232 |
| 4,982,964 | 1/1991 | Morell | 273/232 |
| 4,991,852 | 2/1991 | Pattison | 273/232 |
| 4,998,733 | 3/1991 | Lee | 273/232 |
| 5,009,427 | 4/1991 | Stiefel et al. | 273/232 |
| 5,009,428 | 4/1991 | Yamagishi et al. | 273/232 |
| 5,016,887 | 5/1991 | Jonkouski | 273/232 |
| 5,018,741 | 5/1991 | Stiefel et al. | 273/232 |
| 5,024,444 | 6/1991 | Yamagishi et al. | 273/232 |
| 5,033,750 | 7/1991 | Yamagishi et al. | 273/232 |
| 5,044,638 | 9/1991 | Nesbitt et al. | 273/232 |
| 5,046,742 | 9/1991 | Mackey | 273/232 |
| 5,060,953 | 10/1991 | Bunger et al. | 273/232 |
| 5,060,954 | 10/1991 | Gobush | 273/232 |
| 5,062,644 | 11/1991 | Lee | 273/232 |
| 5,064,199 | 12/1991 | Morell | 273/232 |
| 5,072,945 | 12/1991 | Oka et al. | 273/232 |
| 5,078,402 | 1/1992 | Oka | 273/232 |
| 5,080,367 | 1/1992 | Lynch et al. | 273/232 |
| 5,087,048 | 2/1992 | Sun et al. | 273/232 |
| 5,087,049 | 2/1992 | Yamagishi et al. | 273/232 |
| 5,090,705 | 2/1992 | Oka et al. | 273/232 |
| 5,092,604 | 3/1992 | Oka | 273/232 |
| 5,106,096 | 4/1992 | Dunn | 273/232 |
| 5,123,652 | 6/1992 | Oka | 273/232 |
| 5,127,655 | 7/1992 | Yamada et al. | 273/232 |
| 5,143,377 | 9/1992 | Oka et al. | 273/232 |
| 5,145,180 | 9/1992 | Oka | 273/232 |
| 5,149,100 | 9/1992 | Melvin et al. | 273/232 |
| 5,150,906 | 9/1992 | Molitor et al. | 273/231 X |
| 5,156,404 | 10/1992 | Oka et al. | 273/232 |
| 5,158,300 | 10/1992 | Aoyama | 273/232 |
| 5,174,578 | 12/1992 | Oka et al. | 273/232 |
| 5,190,294 | 3/1993 | Oka | 273/232 |
| 5,192,078 | 3/1993 | Woo | 273/232 |
| 5,192,079 | 3/1993 | Sun et al. | 273/232 |
| 5,201,522 | 3/1993 | Pocklington et al. | 273/232 |
| 5,209,485 | 5/1993 | Nesbitt et al. | 273/232 X |
| 5,249,804 | 10/1993 | Sanchez | 273/232 |
| 5,253,872 | 10/1993 | Lemons et al. | 273/232 |
| 5,259,624 | 11/1993 | Puckett | 273/232 |
| 5,368,304 | 11/1994 | Sullivan et al. | 273/220 |

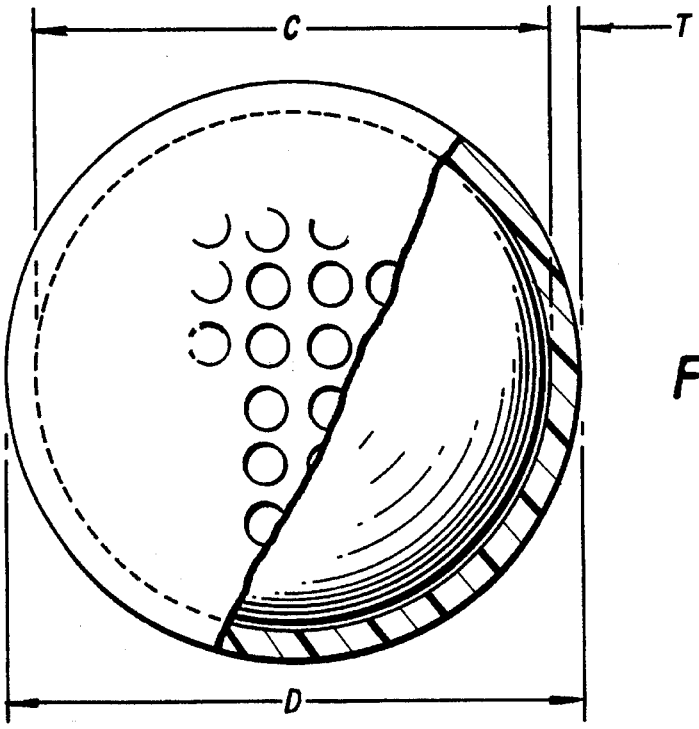
FIG. 1
FIG. 2
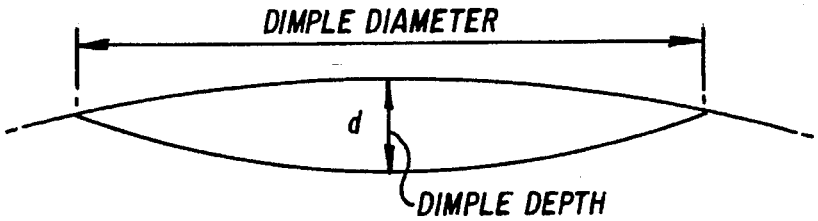
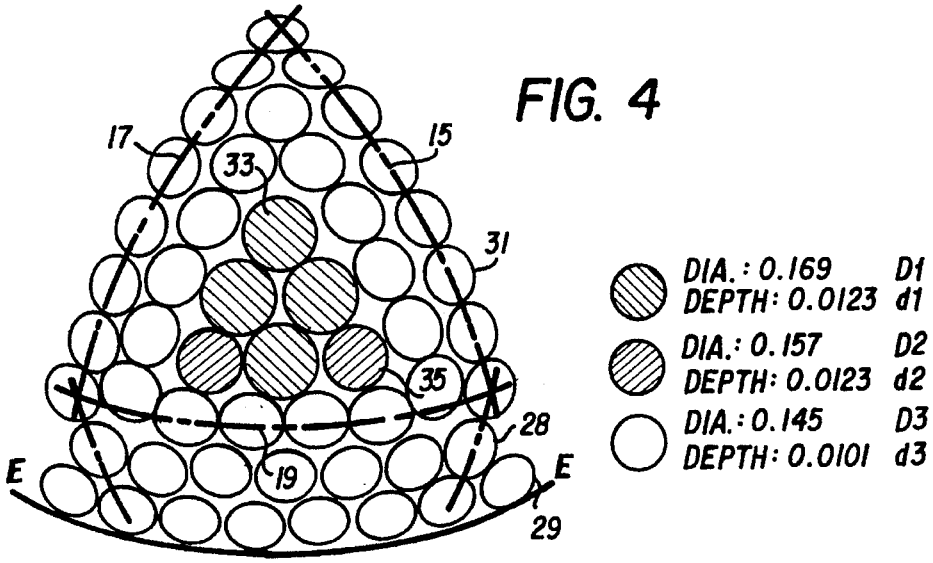
FIG. 4

GOLF BALL

This application is a continuation-in-part of U.S. patent application Ser. No. 08/171,956, filed Dec. 12, 1993, which is a continuation of U.S. patent application Ser. No. 07/800,198, filed Nov. 27, 1991 now U.S. Pat. No. 5,273,287.

This invention relates to golf balls. In particular, it relates to a two-piece golf ball having playability characteristics which are improved relative to state-of-the-art balls.

According to United States Golf Association (U.S.G.A.) rules, a golf ball may not have a weight in excess of 1.620 ounces or a diameter smaller than 1.680 inches. The initial velocity of U.S.G.A. "regulation" balls may not exceed 250 feet per second with a maximum tolerance of 2%. Initial velocity is measured on a standard machine kept by the U.S.G.A. A projection on a wheel rotating at a defined speed hits the test ball, and the length of time it takes the ball to traverse a set distance after impact is measured. U.S.G.A. regulations also require that a ball not travel a distance greater than 280 yards when hit by the U.S.G.A. outdoor driving machine under specified conditions. In addition to this specification, there is a tolerance of plus 4% and a 2% tolerance for test error.

These specifications limit how far a golf ball will travel when hit in several ways. Increasing the weight of a golf ball tends to increase the distance it will travel and lower the trajectory. A ball having greater momentum is better able to overcome drag. Reducing the diameter of the ball also has the effect of increasing the distance it will travel when hit. This is believed to occur primarily because a smaller ball has a smaller projected area and, thus, a lower drag when traveling through the air. Increasing initial velocity increases the distance the ball will travel.

The foregoing generalizations hold when the effect of size, weight, or initial velocity is measured in isolation. Flight characteristics (influenced by dimple pattern and ball rotation properties), club head speed, radius of gyration, and diverse other factors also influence the distance a ball will travel.

In the manufacture of top-grade golf balls for use by professional golfers and amateur golf enthusiasts, the distance a ball will travel when hit (hereinafter referred to as "distance") is an important design criterion. Since the U.S.G.A. rules were established, golf ball manufacturers have designed top-grade U.S.G.A. regulation balls to be as close to the maximum weight, minimum diameter, and maximum initial velocity as golf ball technology will permit. The distance a ball will travel when hit has, however, been improved by changes in raw materials and by alternations in dimple configuration.

Golf balls not conforming to U.S.G.A. specifications in various respects have been made in the United States. Prior to the effective date of the U.S.G.A. rules, balls of various weights, diameters, and resiliencies were common. So-called "rabbit balls," which claim to exceed the U S.G.A. initial velocity limitations, have also been offered for sale. Recently, oversized, overweight golf balls have been on sale for use as golf teaching aids (see U.S. Pat. No. 4,201,384 to Barber).

Oversized golf balls are also disclosed in New Zealand Patent 192,618 dated Jan. 1, 1980, issued to a predecessor of the present assignee. This patent discloses an oversized golf ball having a diameter between 1.700 and 1.730 inches and an oversized core of resilient material so as to increase the coefficient of restitution. Additionally, the patent discloses that the ball should include a cover having a thickness less than the cover thickness of conventional balls. The patent has no disclosure as to dimple size or the percentage of surface coverage by the dimples.

Golf balls made by Spalding in 1915 were of a diameter ranging from 1.630 inches to 1.710 inches. While these balls had small shallow dimples, they covered less than 50% of the surface of the ball. Additionally, as the diameter of the ball increased, the weight of the ball also increased.

Golf balls known as the LYNX JUMBO were also produced and sold in October of 1979. This ball had a diameter of substantially 1.80 inches. The dimples on the LYNX JUMBO balls had 336 Atti-type dimples with each dimple having a diameter of 0.147 inch and a depth of 0.0148 inch. With this dimple arrangement, 56.02% of the surface area of the ball was covered by the dimples. This ball met with little or no commercial success.

Top-grade golf balls sold in the United States may be classified as one of two types: two-piece or three-piece. The two-piece ball, exemplified by the balls sold by Spalding Corporation under the trademark TOP-FLITE, consists of a solid polymeric core and a separately formed cover. The so-called three-piece balls, exemplified by the balls sold under the trademark TITLEIST by the Acushnet Company, consist of a liquid (e.g., TITLEIST TOUR 384) or solid (e.g., TITLEIST DT) center, elastomeric thread windings about the center, and a cover. Although the nature of the cover can, in certain instances, make a significant contribution to the overall coefficient of restitution and initial velocity of a ball (see, for example, U.S. Pat. No. 3,819,768 to Molitor), the initial velocity of two-piece and three-piece balls is determined mainly by the coefficient of restitution of the core. The coefficient of restitution of the core of wound balls can be controlled within limits by regulating the winding tension and the thread and center composition. With respect to two-piece balls, the coefficient of restitution of the core is a function of the properties of the elastomer composition from which it is made. Solid cores today are typically molded using polybutadiene elastomers mixed with acrylate or methacrylate metal salts. High-density fillers such as zinc oxide are included in the core material in order to achieve the maximum U.S.G.A. weight limit.

Improvements in cover and core material formulations and changes in dimple patterns have more or less continually improved golf ball distance for the last 20 years. Top-grade golf balls, however, must meet several other important design criteria. To successfully compete in today's golf ball market, a golf ball should be resistant to cutting and must be finished well; it should hold a line in putting and should have good click and feel. With a well-designed ball, experienced players can better execute shots involving draw, fade, or abrupt stops, as the situation dictates.

SUMMARY OF THE INVENTION

The golf ball of the present invention provides an improvement over previously proposed oversized golf balls. The present ball, even though of a larger diameter of at least 1.70 inches, preferably uses substantially the same size core as a standard golf ball, with the difference in size being provided by additional thickness in the cover of the ball. The enlarged ball includes dimples which cover at least 70% of the surface of the ball, which enhances the flight characteristics of the ball. It has been found that large diameter shallow dimples further enhance the flight characteristics of the golf ball as opposed to the use of a large number of small diameter dimples.

Women golfers tend to have significantly lower average club head speeds than men. The present invention provides a ball having improved playing characteristics for slower club head speeds. Such improvement is attained by providing a ball having a soft core and a selected cover hardness whereby the ball has a P.G.A. compression hardness of 80 or less.

In addition to allowing the use of larger diameter dimples, the larger diameter ball provides a moment which is greater than the conventional ball. This greater moment reveals itself by having a lower backspin rate after impact than the conventional ball. Such a lower backspin rate contributes to straighter shots, greater efficiency in flight, and a lesser degree of energy loss on impact with the ground. On impact with the ground, all balls reverse their spin from backspin to over-spin; hence, having lower backspin on impact, less energy is absorbed in this reversal than with conventional balls. This is especially true with woods because of the lower trajectory resulting from a lower backspin. As a result, the ball strikes the ground at a more acute angle, adding increased roll or distance.

The present ball provides additional control due to the enlarged size of the ball and dimple coverage while still maintaining maximum performance standards as compared to a standard ball.

The advantages of the present invention will be more clearly understood from the following description taken together with the drawings.

BRIEF DESCRIPTION OF THE DRAWINGS

FIG. 1 illustrates a partially broken-away view of an embodiment of the improved golf ball of the present invention;

FIG. 2 illustrates dimple diameter and depth measurements;

FIG. 4 is a schematic illustration showing dimple size and location of the repetitive sections of the golf ball of FIG. 3;

DETAILED DESCRIPTION OF THE PREFERRED EMBODIMENT

Figure 3:
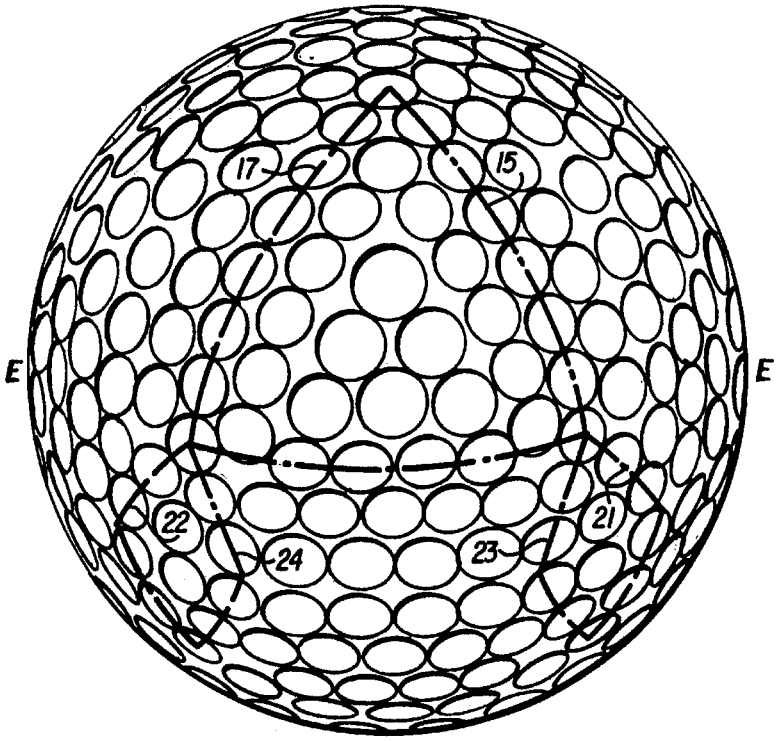
FIG. 3 discloses a golf ball of the dimensions as shown in FIG. 1 with a particular dimple configuration.

The following description relates to several particular embodiments of the golf ball of the present invention, but the concept of the present invention is not to be limited to such embodiments. It should be noted that all of the specific dimensions set forth have a manufacturing tolerance of ±0.05%. Additionally, all of the balls have a weight no greater than 1.62 ounces.

The diameter of the ball is substantially between 1.71 and 1.80 inches. When dimples having different diameters and depths are used, weighted average dimple diameter is used in relation to the following parameters. Obviously, when all the dimples used are of the same diameter and depth, the weighted average diameter and depth is the same as each dimple diameter and depth. The weighted average diameter of the dimples covering the ball is substantially between 0.100 and 0.190 inch, preferably between 0.135 and 0.170 inch, with the preferred weighted average dimple diameter being between 0.139 and 0.149 inch. The weighted average depth of the dimples covering the ball is between 0.005 and 0.015 inch, preferably between 0.009 and 0.013 inch, with the preferred depth being between 0.010 and 0.011 inch.

Referring to FIG. 1, there is disclosed a ball having an oversized diameter D as compared to the diameter of a standard ball. The ball has a core of a diameter C and a cover of a thickness T. As opposed to previously proposed golf balls such as that disclosed in the above-mentioned New Zealand patent, the present invention does not use an oversize core in the oversized golf ball. In the particular ball used for illustrative purposes, the nominal diameter of the ball is 1.717±0.010 inches, the diameter of the core is 1.545±0.010 inches, and the cover thickness is 0.086±0.010 inch.

The dimple pattern discussed above provides coverage of between 70% and 85% of the surface of the ball. It should be noted that if maximum possible coverage is desired, noncircular dimples can be used to fill in open surface areas which may remain after the basic dimple pattern is determined.

The core and cover hardness of the ball of the present invention are such that the P.G.A. compression is 80 or less. Although the ball is larger than the standard ball, the weight of the ball does not exceed 1.62 ounces.

The following static data is specific to one embodiment of the ball of the present invention:

| MOLDED CENTER CORE | |
|---|---|
| SIZE: AVERAGE | 1.543" ± .005 |
| WEIGHT: AVERAGE (Grams) | 34.4 ± 0.3 |
| COMPRESSION: RIEHLE | .108 ± .005 |
| PGA | 52 ± 5 |
| C.O.R.: AVERAGE | .784 ± .010 |
| **MOLDED BALL** | |
| SIZE: AVERAGE | 1.717" ± .003 |
| WEIGHT: AVERAGE (Grams) | 45.4 ± .2 |
| COMPRESSION: RIEHLE | .090 ± .005 |
| PGA | 70 ± 5 |
| C.O.R.: AVERAGE | .798 ± .005 |
| **FINISHED BALL** | |
| SIZE: AVERAGE | 1.717 ± .003 |
| WEIGHT: AVERAGE (Grams) | 45.4 ± .2 |
| COMPRESSION: RIEHLE | .086 ± .005 |
| PGA | 74 ± 5 |
| C.O.R.: AVERAGE | .800 ± .005 |

CENTER CORE FORMULATION

| COMPOUND | PARTS |
|---|---|
| CARIFLEX BR-1220 | 100.0 |
| ZDA | 20.0 |
| ZnO | 13.0 |
| Zn STEARATE | 15.0 |
| GROUND FLASH (T.G.) | 10.0 |
| 231 XL | 0.9 |
| | 158.9 |

Cariflex BR-1200 is high C'S 1,4 polybutadiene rubber available from Shell Chemical.
ZDA is Zinc Diacrylate available from Rockland React-Rite.
ZnO is Zinc Oxide.
Ground Flash is top-grade center flash.
231 XL is 40% peroxide.

COVER FORMULATION

| | |
|---|---|
| SURLYN 8320 | 17.4 |
| SURLYN 8120 | 7.5 |
| SURLYN 9910 | 49.0 |
| SURLYN 8940 | 16.4 |
| WHITE M.B. | 9.7 |
| | 100.0 |

The cover is made from various blends of ionomers sold by Exxon Chemical Co. and Dupont Chemical Co.

This formulation provides a medium modulus cover having a Shore D hardness of 62. As can be seen, applying this cover to the above molded center will increase the P.G.A. compression by ±22 points and increase the C.O.R. by ±0.016 points. The preferred range of the C.O.R. is from 0.780 to 0.825.

Using the dimple pattern shown in FIG. 3, comparative tests were conducted with the ball of the example (designated TOP-FLITE MAGNA W) as well as other balls specifically designed for use by women. A 13° driver having a head speed of 120 f.p.s. was used for all balls.

| BALL TYPE | TRAJ | FLIGHT TIME | CARRY | CARRY DIFF | ROLL | TOTAL DIST | TOTAL DIFF |
|---|---|---|---|---|---|---|---|
| TOP-FLITE MAGNA W | 15.1 | 5.4 | 175.0 | 0.0 | 12.6 | 187.7 | 0.0 |
| DT90 | 14.4 | 5.3 | 169.6 | −5.4 | 12.1 | 181.6 | −6.1 |
| PROSTAFF | 15.7 | 5.3 | 170.9 | −4.1 | 9.4 | 180.2 | −7.5 |
| HVC 90 | 14.4 | 5.3 | 173.7 | −1.3 | 12.3 | 186.0 | −1.7 |
| PINN 90 | 15.2 | 5.4 | 172.2 | −2.8 | 12.2 | 184.4 | −3.3 |
| EVLADY | 15.5 | 5.4 | 172.6 | −2.4 | 12.4 | 185.0 | −2.7 |
| DT80 | 14.5 | 5.4 | 170.4 | −4.6 | 10.1 | 180.5 | −7.2 |

BALL IDENTIFICATION

| | |
|---|---|
| TOP-FLITE MAGNA W | SPALDING |
| DT 90 | TITLEIST |
| PRO STAFF | WILSON |
| HVC 90 | TITLEIST |
| PINNACLE 90 | TITLEIST |
| PRECEPT EV LADY | BRIDGESTONE |
| DT 80 | TITLEIST |

The above tests illustrate the improved performance of the ball: ball of the present invention.

There follows the coordinates of the dimple pattern of the ball of FIGS. 3 and 4, indicating dimple location and diameter for each dimple on one of the hemispheres of the

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 1 | 0 | 0 | 0 | 0 | 0 | 0 | 0.1450 |
| 2 | 9 | 42 | 45 | 36 | 0 | 0 | 0.1450 |
| 3 | 9 | 42 | 45 | 108 | 0 | 0 | 0.1450 |
| 4 | 9 | 42 | 45 | 180 | 0 | 0 | 0.1450 |
| 5 | 9 | 42 | 45 | 252 | 0 | 0 | 0.1450 |
| 6 | 9 | 42 | 45 | 324 | 0 | 0 | 0.1450 |
| 7 | 16 | 15 | 45 | 0 | 0 | 0 | 0.1450 |
| 8 | 16 | 15 | 45 | 72 | 0 | 0 | 0.1450 |
| 9 | 16 | 15 | 45 | 144 | 0 | 0 | 0.1450 |
| 10 | 16 | 15 | 45 | 216 | 0 | 0 | 0.1450 |
| 11 | 16 | 15 | 45 | 288 | 0 | 0 | 0.1450 |
| 12 | 19 | 26 | 0 | 36 | 0 | 0 | 0.1450 |
| 13 | 19 | 26 | 0 | 108 | 0 | 0 | 0.1450 |
| 14 | 19 | 26 | 0 | 180 | 0 | 0 | 0.1450 |
| 15 | 19 | 26 | 0 | 252 | 0 | 0 | 0.1450 |
| 16 | 19 | 26 | 0 | 324 | 0 | 0 | 0.1450 |
| 17 | 25 | 18 | 0 | 13 | 26 | 0 | 0.1450 |
| 18 | 25 | 18 | 0 | 58 | 34 | 0 | 0.1450 |
| 19 | 25 | 18 | 0 | 85 | 26 | 0 | 0.1450 |
| 20 | 25 | 18 | 0 | 130 | 34 | 0 | 0.1450 |
| 21 | 25 | 18 | 0 | 157 | 26 | 0 | 0.1450 |
| 22 | 25 | 18 | 0 | 202 | 34 | 0 | 0.1450 |
| 23 | 25 | 18 | 0 | 229 | 26 | 0 | 0.1450 |
| 24 | 25 | 18 | 0 | 274 | 34 | 0 | 0.1450 |
| 25 | 25 | 18 | 0 | 301 | 26 | 0 | 0.1450 |
| 26 | 25 | 18 | 0 | 346 | 34 | 0 | 0.1450 |
| 27 | 29 | 19 | 0 | 36 | 0 | 0 | 0.1450 |
| 28 | 29 | 19 | 0 | 108 | 0 | 0 | 0.1450 |
| 29 | 29 | 19 | 0 | 180 | 0 | 0 | 0.1450 |
| 30 | 29 | 19 | 0 | 252 | 0 | 0 | 0.1450 |
| 31 | 29 | 19 | 0 | 324 | 0 | 0 | 0.1450 |
| 32 | 34 | 33 | 30 | 19 | 50 | 0 | 0.1450 |
| 33 | 34 | 33 | 30 | 52 | 10 | 0 | 0.1450 |
| 34 | 34 | 33 | 30 | 91 | 50 | 0 | 0.1450 |
| 35 | 34 | 33 | 30 | 124 | 10 | 0 | 0.1450 |
| 36 | 34 | 33 | 30 | 163 | 50 | 0 | 0.1450 |
| 37 | 34 | 33 | 30 | 196 | 10 | 0 | 0.1450 |
| 38 | 34 | 33 | 39 | 235 | 50 | 0 | 0.1450 |
| 39 | 34 | 33 | 30 | 268 | 10 | 0 | 0.1450 |
| 40 | 34 | 33 | 30 | 307 | 50 | 0 | 0.1450 |
| 41 | 34 | 33 | 30 | 340 | 10 | 0 | 0.1450 |
| 42 | 36 | 52 | 30 | 0 | 0 | 0 | 0.1690 |
| 43 | 36 | 52 | 30 | 72 | 0 | 0 | 0.1690 |
| 44 | 36 | 52 | 30 | 144 | 0 | 0 | 0.1690 |
| 45 | 36 | 52 | 30 | 216 | 0 | 0 | 0.1690 |

-continued

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 46 | 36 | 52 | 30 | 288 | 0 | 0 | 0.1690 |
| 47 | 39 | 2 | 45 | 36 | 0 | 0 | 0.1450 |
| 48 | 39 | 2 | 45 | 108 | 0 | 0 | 0.1450 |
| 49 | 39 | 2 | 45 | 180 | 0 | 0 | 0.1450 |
| 50 | 39 | 2 | 45 | 252 | 0 | 0 | 0.1450 |
| 51 | 39 | 2 | 45 | 324 | 0 | 0 | 0.1450 |
| 52 | 44 | 9 | 30 | 23 | 33 | 15 | 0.1450 |
| 53 | 44 | 9 | 30 | 48 | 26 | 45 | 0.1450 |
| 54 | 44 | 9 | 30 | 95 | 33 | 15 | 0.1450 |
| 55 | 44 | 9 | 30 | 120 | 26 | 45 | 0.1450 |
| 56 | 44 | 9 | 30 | 167 | 33 | 15 | 0.1450 |
| 57 | 44 | 9 | 30 | 192 | 26 | 45 | 0.1450 |
| 58 | 44 | 9 | 30 | 239 | 33 | 15 | 0.1450 |
| 59 | 44 | 9 | 30 | 264 | 26 | 45 | 0.1450 |
| 60 | 44 | 9 | 30 | 311 | 33 | 15 | 0.1450 |
| 61 | 44 | 9 | 30 | 336 | 26 | 45 | 0.1450 |
| 62 | 46 | 50 | 15 | 8 | 34 | 45 | 0.1690 |
| 63 | 46 | 50 | 15 | 63 | 25 | 15 | 0.1690 |
| 64 | 46 | 50 | 15 | 80 | 34 | 45 | 0.1690 |
| 65 | 46 | 50 | 15 | 135 | 25 | 15 | 0.1690 |
| 66 | 46 | 50 | 15 | 152 | 34 | 45 | 0.1690 |
| 67 | 46 | 50 | 15 | 207 | 25 | 15 | 0.1690 |
| 68 | 46 | 50 | 15 | 224 | 34 | 45 | 0.1690 |
| 69 | 46 | 50 | 15 | 279 | 25 | 15 | 0.1690 |
| 70 | 46 | 50 | 15 | 296 | 34 | 45 | 0.1690 |
| 71 | 46 | 50 | 15 | 351 | 25 | 15 | 0.1690 |
| 72 | 48 | 55 | 0 | 36 | 0 | 0 | 0.1450 |
| 73 | 48 | 55 | 0 | 108 | 0 | 0 | 0.1450 |
| 74 | 48 | 55 | 0 | 180 | 0 | 0 | 0.1450 |
| 75 | 48 | 55 | 0 | 252 | 0 | 0 | 0.1450 |
| 76 | 48 | 55 | 0 | 324 | 0 | 0 | 0.1450 |
| 77 | 53 | 50 | 15 | 25 | 15 | 45 | 0.1450 |
| 78 | 53 | 50 | 15 | 46 | 44 | 15 | 0.1450 |
| 79 | 53 | 50 | 15 | 97 | 15 | 45 | 0.1450 |
| 80 | 53 | 50 | 15 | 118 | 44 | 15 | 0.1450 |
| 81 | 53 | 50 | 15 | 169 | 15 | 45 | 0.1450 |
| 82 | 53 | 50 | 15 | 190 | 44 | 15 | 0.1450 |
| 83 | 53 | 50 | 15 | 241 | 15 | 45 | 0.1450 |
| 84 | 53 | 50 | 15 | 262 | 44 | 15 | 0.1450 |
| 85 | 53 | 50 | 15 | 313 | 15 | 45 | 0.1450 |
| 86 | 53 | 50 | 15 | 334 | 44 | 15 | 0.1450 |
| 87 | 56 | 37 | 30 | 0 | 0 | 0 | 0.1690 |
| 88 | 56 | 37 | 30 | 72 | 0 | 0 | 0.1690 |
| 89 | 56 | 37 | 30 | 144 | 0 | 0 | 0.1690 |
| 90 | 56 | 37 | 30 | 216 | 0 | 0 | 0.1690 |
| 91 | 56 | 37 | 30 | 288 | 0 | 0 | 0.1690 |
| 92 | 57 | 12 | 0 | 13 | 39 | 0 | 0.1570 |
| 93 | 57 | 12 | 0 | 58 | 21 | 0 | 0.1570 |
| 94 | 57 | 12 | 0 | 85 | 39 | 0 | 0.1570 |
| 95 | 57 | 12 | 0 | 130 | 21 | 0 | 0.1570 |
| 96 | 57 | 12 | 0 | 157 | 39 | 0 | 0.1570 |
| 97 | 57 | 12 | 0 | 202 | 21 | 0 | 0.1570 |
| 98 | 57 | 12 | 0 | 229 | 39 | 0 | 0.1570 |
| 99 | 57 | 12 | 0 | 274 | 21 | 0 | 0.1570 |
| 100 | 57 | 12 | 0 | 301 | 39 | 0 | 0.1570 |
| 101 | 57 | 12 | 0 | 346 | 21 | 0 | 0.1570 |
| 102 | 58 | 39 | 15 | 36 | 0 | 0 | 0.1450 |
| 103 | 58 | 39 | 15 | 108 | 0 | 0 | 0.1450 |
| 104 | 58 | 39 | 15 | 180 | 0 | 0 | 0.1450 |
| 105 | 58 | 39 | 15 | 252 | 0 | 0 | 0.1450 |
| 106 | 58 | 39 | 15 | 324 | 0 | 0 | 0.1450 |
| 107 | 63 | 51 | 30 | 26 | 25 | 15 | 0.1450 |
| 108 | 63 | 51 | 30 | 45 | 34 | 45 | 0.1450 |
| 109 | 63 | 51 | 30 | 98 | 25 | 15 | 0.1450 |
| 110 | 63 | 51 | 30 | 117 | 34 | 45 | 0.1450 |
| 111 | 63 | 51 | 30 | 170 | 25 | 15 | 0.1450 |
| 112 | 63 | 51 | 30 | 189 | 34 | 45 | 0.1450 |
| 113 | 63 | 51 | 30 | 242 | 25 | 15 | 0.1450 |
| 114 | 63 | 51 | 30 | 261 | 34 | 45 | 0.1450 |
| 115 | 63 | 51 | 30 | 314 | 25 | 15 | 0.1450 |
| 116 | 63 | 51 | 30 | 333 | 34 | 45 | 0.1450 |
| 117 | 66 | 36 | 0 | 5 | 24 | 0 | 0.1450 |
| 118 | 66 | 36 | 0 | 66 | 36 | 0 | 0.1450 |
| 119 | 66 | 36 | 0 | 77 | 24 | 0 | 0.1450 |
| 120 | 66 | 36 | 0 | 138 | 36 | 0 | 0.1450 |
| 121 | 66 | 36 | 0 | 149 | 24 | 0 | 0.1450 |

-continued

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 122 | 66 | 36 | 0 | 210 | 36 | 0 | 0.1450 |
| 123 | 66 | 36 | 0 | 221 | 24 | 0 | 0.1450 |
| 124 | 66 | 36 | 0 | 282 | 36 | 0 | 0.1450 |
| 125 | 66 | 36 | 0 | 293 | 24 | 0 | 0.1450 |
| 126 | 66 | 36 | 0 | 354 | 36 | 0 | 0.1450 |
| 127 | 67 | 4 | 30 | 16 | 5 | 30 | 0.1450 |
| 128 | 67 | 4 | 30 | 55 | 54 | 30 | 0.1450 |
| 129 | 67 | 4 | 30 | 88 | 5 | 30 | 0.1450 |
| 130 | 67 | 4 | 30 | 127 | 54 | 30 | 0.1450 |
| 131 | 67 | 4 | 30 | 160 | 5 | 30 | 0.1450 |
| 132 | 67 | 4 | 30 | 199 | 54 | 30 | 0.1450 |
| 133 | 67 | 4 | 30 | 232 | 5 | 30 | 0.1450 |
| 134 | 67 | 4 | 30 | 271 | 54 | 30 | 0.1450 |
| 135 | 67 | 4 | 30 | 304 | 5 | 30 | 0.1450 |
| 136 | 67 | 4 | 30 | 343 | 54 | 30 | 0.1450 |
| 137 | 68 | 20 | 30 | 36 | 0 | 0 | 0.1450 |
| 138 | 68 | 20 | 30 | 108 | 0 | 0 | 0.1450 |
| 139 | 68 | 20 | 30 | 180 | 0 | 0 | 0.1450 |
| 140 | 68 | 20 | 30 | 252 | 0 | 0 | 0.1450 |
| 141 | 68 | 20 | 30 | 324 | 0 | 0 | 0.1450 |
| 142 | 75 | 24 | 30 | 0 | 0 | 0 | 0.1450 |
| 143 | 75 | 24 | 30 | 72 | 0 | 0 | 0.1450 |
| 144 | 75 | 24 | 30 | 144 | 0 | 0 | 0.1450 |
| 145 | 75 | 24 | 30 | 216 | 0 | 0 | 0.1450 |
| 146 | 75 | 24 | 30 | 288 | 0 | 0 | 0.1450 |
| 147 | 75 | 42 | 0 | 10 | 20 | 45 | 0.1450 |
| 148 | 75 | 42 | 0 | 61 | 39 | 15 | 0.1450 |
| 149 | 75 | 42 | 0 | 82 | 20 | 45 | 0.1450 |
| 150 | 75 | 42 | 0 | 133 | 39 | 15 | 0.1450 |
| 151 | 75 | 42 | 0 | 154 | 20 | 45 | 0.1450 |
| 152 | 75 | 42 | 0 | 205 | 39 | 15 | 0.1450 |
| 153 | 75 | 42 | 0 | 226 | 20 | 45 | 0.1450 |
| 154 | 75 | 42 | 0 | 277 | 39 | 15 | 0.1450 |
| 155 | 75 | 42 | 0 | 298 | 20 | 45 | 0.1450 |
| 156 | 75 | 42 | 0 | 349 | 39 | 15 | 0.1450 |
| 157 | 76 | 14 | 0 | 20 | 20 | 0 | 0.1450 |
| 158 | 76 | 14 | 0 | 51 | 40 | 0 | 0.1450 |
| 159 | 76 | 14 | 0 | 92 | 20 | 0 | 0.1450 |
| 160 | 76 | 14 | 0 | 123 | 40 | 0 | 0.1450 |
| 161 | 76 | 14 | 0 | 164 | 20 | 0 | 0.1450 |
| 162 | 76 | 14 | 0 | 195 | 40 | 0 | 0.1450 |
| 163 | 76 | 14 | 0 | 236 | 20 | 0 | 0.1450 |
| 164 | 76 | 14 | 0 | 267 | 40 | 0 | 0.1450 |
| 165 | 76 | 14 | 0 | 308 | 20 | 0 | 0.1450 |
| 166 | 76 | 14 | 0 | 339 | 40 | 0 | 0.1450 |
| 167 | 76 | 26 | 15 | 30 | 22 | 15 | 0.1450 |
| 168 | 76 | 26 | 15 | 41 | 37 | 45 | 0.1450 |
| 169 | 76 | 26 | 15 | 102 | 22 | 15 | 0.1450 |
| 170 | 76 | 26 | 15 | 113 | 37 | 45 | 0.1450 |
| 171 | 76 | 26 | 15 | 174 | 22 | 15 | 0.1450 |
| 172 | 76 | 26 | 15 | 185 | 37 | 45 | 0.1450 |
| 173 | 76 | 26 | 15 | 246 | 22 | 15 | 0.1450 |
| 174 | 76 | 26 | 15 | 257 | 37 | 45 | 0.1450 |
| 175 | 76 | 26 | 15 | 318 | 22 | 15 | 0.1450 |
| 176 | 76 | 26 | 15 | 329 | 37 | 45 | 0.1450 |
| 177 | 86 | 1 | 15 | 5 | 8 | 30 | 0.1450 |
| 178 | 86 | 1 | 15 | 15 | 25 | 45 | 0.1450 |
| 179 | 85 | 1 | 15 | 25 | 42 | 45 | 0.1450 |
| 180 | 85 | 1 | 15 | 36 | 0 | 0 | 0.1450 |
| 181 | 85 | 1 | 15 | 46 | 17 | 15 | 0.1450 |
| 182 | 85 | 1 | 15 | 56 | 34 | 15 | 0.1450 |
| 183 | 85 | 1 | 15 | 66 | 51 | 30 | 0.1450 |
| 184 | 85 | 1 | 15 | 77 | 8 | 30 | 0.1450 |
| 185 | 85 | 1 | 15 | 87 | 25 | 45 | 0.1450 |
| 186 | 85 | 1 | 15 | 97 | 42 | 45 | 0.1450 |
| 187 | 85 | 1 | 15 | 108 | 0 | 0 | 0.1450 |
| 188 | 85 | 1 | 15 | 118 | 17 | 15 | 0.1450 |
| 189 | 85 | 1 | 15 | 128 | 34 | 15 | 0.1450 |
| 190 | 85 | 1 | 15 | 138 | 51 | 30 | 0.1450 |
| 191 | 85 | 1 | 15 | 149 | 8 | 30 | 0.1450 |
| 192 | 85 | 1 | 15 | 159 | 25 | 45 | 0.1450 |
| 193 | 85 | 1 | 15 | 169 | 42 | 45 | 0.1450 |
| 194 | 85 | 1 | 15 | 180 | 0 | 0 | 0.1450 |
| 195 | 85 | 1 | 15 | 190 | 17 | 15 | 0.1450 |
| 196 | 85 | 1 | 15 | 200 | 34 | 15 | 0.1450 |
| 197 | 85 | 1 | 15 | 210 | 51 | 30 | 0.1450 |

-continued

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 198 | 85 | 1 | 15 | 221 | 8 | 30 | 0.1450 |
| 199 | 85 | 1 | 15 | 231 | 25 | 45 | 0.1450 |
| 200 | 85 | 1 | 15 | 241 | 42 | 45 | 0.1450 |
| 201 | 85 | 1 | 15 | 252 | 0 | 0 | 0.1450 |
| 202 | 85 | 1 | 15 | 262 | 17 | 15 | 0.1450 |
| 203 | 85 | 1 | 15 | 272 | 34 | 15 | 0.1450 |
| 204 | 85 | 1 | 15 | 282 | 51 | 30 | 0.1450 |
| 205 | 85 | 1 | 15 | 293 | 8 | 30 | 0.1450 |
| 206 | 85 | 1 | 15 | 303 | 25 | 45 | 0.1450 |
| 207 | 85 | 1 | 15 | 313 | 42 | 45 | 0.1450 |
| 208 | 85 | 1 | 15 | 324 | 0 | 0 | 0.1450 |
| 209 | 85 | 1 | 15 | 334 | 17 | 15 | 0.1450 |
| 210 | 85 | 1 | 15 | 344 | 34 | 15 | 0.1450 |
| 211 | 85 | 1 | 15 | 354 | 51 | 30 | 0.1450 |

The ball of FIGS. 3 and 4 illustrates that the dimple pattern on the ball is made up of a plurality of triangles 15, 17 and 19 which comprise a modified icosahedron. The dimples are arranged on the ball in order to obtain maximum surface coverage of the ball, with the largest dimples 33, intermediate dimples 35, and smaller dimples 31 being located as shown relative to lines 15, 17, and 19 of the triangles. Lines 21, 23, and 24 are extensions of a further triangle to the equatorial line of the ball. This is the same arrangement of dimples as that of the Spalding TOP-FLITE PLUS II ball shown and described in U.S. patent application Ser. No. 07/384,205, assigned to the assignee of the present invention. The description and the manner of locating the dimples as set forth in that application is incorporated herein.

A further ball which uses the same basic pattern of FIGS. 3 and 4 has 10 of the largest diameter dimples, 50 of the intermediate size dimples, and 362 of the smallest diameter dimples. The largest dimple diameter is 0.169 inch with a depth of 0.0123 inch, the intermediate dimple diameter is 0.157 inch with a depth of 0.0123 inch, and the smallest dimple diameter is 0.145 inch with a depth of 0.0101 inch. Thus, the dimple depths of the three different diameter dimples remain the same as the ball of FIGS. 2 and 3. This modification provides a coverage with no dimple overlap while maintaining a 77.4% coverage of the surface area of the ball. The weighted average dimple diameter for this ball is 0.1470 inch and the weighted average dimple depth is 0.0104 inch.

Still another ball which uses the same basic pattern of FIGS. 3 and 4 has 10 of the largest diameter dimples, 50 of the intermediate size dimples, and 362 of the smallest diameter dimples. This pattern has a modified dimple diameter wherein the largest diameter is 0.169 inch with a depth of 0.0128 inch, the intermediate dimple diameter is 0.157 inch with a depth of 0.0128 inch, and the smallest dimple diameter is 0.145 inch. In this ball, 222 of the smallest diameter dimples nearest the poles have a depth of 0.0106 inch and the remaining 140 of the smallest diameter dimples have a depth of 0.0096 inch. The remaining intermediate and large diameter dimples have a depth of 0.0128 inch. This modification provides a ball with no dimple overlap while maintaining a 77.4% coverage of the surface area of the ball. The weighted average dimple diameter for this ball is 0.1470 inch and the weighted average dimple depth is 0.01058 inch.

There follows the coordinates for the dimple pattern of the above two balls having 10 large dimples, 50 intermediate dimples, and 362 small dimples:

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 1 | 0 | 0 | 0 | 0 | 0 | 0 | 0.145 |
| 2 | 9 | 42 | 45 | 36 | 0 | 0 | 0.145 |
| 3 | 9 | 42 | 45 | 108 | 0 | 0 | 0.145 |
| 4 | 9 | 42 | 45 | 180 | 0 | 0 | 0.145 |
| 5 | 9 | 42 | 45 | 252 | 0 | 0 | 0.145 |
| 6 | 9 | 42 | 45 | 324 | 0 | 0 | 0.145 |
| 7 | 16 | 15 | 45 | 0 | 0 | 0 | 0.145 |
| 8 | 16 | 15 | 45 | 72 | 0 | 0 | 0.145 |
| 9 | 16 | 15 | 45 | 144 | 0 | 0 | 0.145 |
| 10 | 16 | 15 | 45 | 216 | 0 | 0 | 0.145 |
| 11 | 16 | 15 | 45 | 288 | 0 | 0 | 0.145 |
| 12 | 19 | 26 | 0 | 36 | 0 | 0 | 0.145 |
| 13 | 19 | 26 | 0 | 108 | 0 | 0 | 0.145 |
| 14 | 19 | 26 | 0 | 180 | 0 | 0 | 0.145 |
| 15 | 19 | 16 | 0 | 252 | 0 | 0 | 0.145 |
| 16 | 19 | 26 | 0 | 324 | 0 | 0 | 0.145 |
| 17 | 25 | 18 | 0 | 13 | 26 | 0 | 0.145 |
| 18 | 25 | 18 | 0 | 58 | 34 | 0 | 0.145 |
| 19 | 25 | 18 | 0 | 85 | 26 | 0 | 0.145 |
| 20 | 25 | 18 | 0 | 130 | 34 | 0 | 0.145 |
| 21 | 25 | 18 | 0 | 157 | 26 | 0 | 0.145 |
| 22 | 25 | 18 | 0 | 202 | 34 | 0 | 0.145 |
| 23 | 25 | 18 | 0 | 229 | 26 | 0 | 0.145 |

-continued

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 24 | 25 | 18 | 0 | 274 | 34 | 0 | 0.145 |
| 25 | 25 | 18 | 0 | 301 | 26 | 0 | 0.145 |
| 26 | 25 | 18 | 0 | 346 | 34 | 0 | 0.145 |
| 27 | 29 | 19 | 0 | 36 | 0 | 0 | 0.145 |
| 28 | 29 | 19 | 0 | 108 | 0 | 0 | 0.145 |
| 29 | 29 | 19 | 0 | 180 | 0 | 0 | 0.145 |
| 30 | 29 | 19 | 0 | 252 | 0 | 0 | 0.145 |
| 31 | 29 | 19 | 0 | 324 | 0 | 0 | 0.145 |
| 32 | 34 | 33 | 30 | 19 | 50 | 0 | 0.145 |
| 33 | 34 | 33 | 30 | 52 | 10 | 0 | 0.145 |
| 34 | 34 | 33 | 30 | 91 | 50 | 0 | 0.145 |
| 35 | 34 | 33 | 39 | 124 | 10 | 0 | 0.145 |
| 36 | 34 | 33 | 30 | 163 | 50 | 0 | 0.145 |
| 37 | 34 | 33 | 30 | 196 | 10 | 0 | 0.145 |
| 38 | 34 | 33 | 30 | 235 | 50 | 0 | 0.145 |
| 39 | 34 | 33 | 30 | 268 | 10 | 0 | 0.145 |
| 40 | 34 | 33 | 30 | 307 | 50 | 0 | 0.145 |
| 41 | 34 | 33 | 30 | 340 | 10 | 0 | 0.145 |
| 42 | 38 | 5 | 0 | 0 | 0 | 0 | 0.157 |
| 43 | 38 | 5 | 0 | 72 | 0 | 0 | 0.157 |
| 44 | 38 | 5 | 0 | 144 | 0 | 0 | 0.157 |
| 45 | 38 | 5 | 0 | 216 | 0 | 0 | 0.157 |
| 46 | 38 | 5 | 0 | 288 | 0 | 0 | 0.157 |
| 47 | 39 | 2 | 45 | 36 | 0 | 0 | 0.145 |
| 48 | 39 | 2 | 45 | 108 | 0 | 0 | 0.145 |
| 49 | 39 | 2 | 45 | 180 | 0 | 0 | 0.145 |
| 50 | 39 | 2 | 45 | 252 | 0 | 0 | 0.145 |
| 51 | 39 | 2 | 45 | 324 | 0 | 0 | 0.145 |
| 52 | 44 | 9 | 30 | 23 | 33 | 15 | 0.145 |
| 53 | 44 | 9 | 30 | 48 | 26 | 45 | 0.145 |
| 54 | 44 | 9 | 30 | 95 | 33 | 15 | 0.145 |
| 55 | 44 | 9 | 30 | 120 | 26 | 45 | 0.145 |
| 56 | 44 | 9 | 30 | 167 | 33 | 15 | 0.145 |
| 57 | 44 | 9 | 30 | 192 | 26 | 45 | 0.145 |
| 58 | 44 | 9 | 30 | 239 | 33 | 15 | 0.145 |
| 59 | 44 | 8 | 39 | 264 | 26 | 45 | 0.145 |
| 60 | 44 | 9 | 30 | 311 | 33 | 15 | 0.145 |
| 61 | 44 | 9 | 30 | 336 | 26 | 45 | 0.145 |
| 62 | 47 | 33 | 30 | 7 | 34 | 0 | 0.157 |
| 63 | 47 | 33 | 30 | 64 | 26 | 0 | 0.157 |
| 64 | 47 | 33 | 30 | 79 | 34 | 0 | 0.157 |
| 65 | 47 | 33 | 30 | 136 | 26 | 0 | 0.157 |
| 66 | 47 | 33 | 30 | 151 | 34 | 0 | 0.157 |
| 67 | 47 | 33 | 30 | 208 | 26 | 0 | 0.157 |
| 68 | 47 | 33 | 30 | 223 | 34 | 0 | 0.157 |
| 69 | 47 | 33 | 30 | 280 | 26 | 0 | 0.157 |
| 70 | 47 | 33 | 30 | 295 | 34 | 0 | 0.157 |
| 71 | 47 | 33 | 30 | 352 | 26 | 0 | 0.157 |
| 72 | 48 | 55 | 0 | 36 | 0 | 0 | 0.145 |
| 73 | 48 | 55 | 0 | 108 | 0 | 0 | 0.145 |
| 74 | 48 | 55 | 0 | 180 | 0 | 0 | 0.145 |
| 75 | 48 | 55 | 0 | 252 | 0 | 0 | 0.145 |
| 76 | 48 | 55 | 0 | 324 | 0 | 0 | 0.145 |
| 77 | 53 | 50 | 15 | 25 | 15 | 45 | 0.145 |
| 78 | 53 | 50 | 15 | 46 | 44 | 15 | 0.145 |
| 79 | 53 | 50 | 15 | 97 | 15 | 45 | 0.145 |
| 80 | 53 | 50 | 15 | 118 | 44 | 15 | 0.145 |
| 81 | 53 | 50 | 15 | 169 | 15 | 45 | 0.145 |
| 82 | 53 | 50 | 15 | 190 | 44 | 15 | 0.145 |
| 83 | 53 | 50 | 15 | 241 | 15 | 45 | 0.145 |
| 84 | 53 | 50 | 15 | 262 | 44 | 15 | 0.145 |
| 85 | 53 | 50 | 15 | 313 | 15 | 45 | 0.145 |
| 86 | 53 | 50 | 15 | 334 | 44 | 15 | 0.145 |
| 87 | 57 | 12 | 0 | 13 | 39 | 0 | 0.157 |
| 88 | 57 | 12 | 0 | 58 | 21 | 0 | 0.157 |
| 89 | 57 | 12 | 0 | 85 | 39 | 0 | 0.157 |
| 90 | 57 | 12 | 0 | 130 | 21 | 0 | 0.157 |
| 91 | 57 | 12 | 0 | 157 | 39 | 0 | 0.157 |
| 92 | 57 | 12 | 0 | 202 | 21 | 0 | 0.157 |
| 93 | 57 | 12 | 0 | 229 | 39 | 0 | 0.157 |
| 94 | 57 | 12 | 0 | 274 | 21 | 0 | 0.157 |
| 95 | 57 | 12 | 0 | 301 | 39 | 0 | 0.157 |
| 96 | 57 | 12 | 0 | 346 | 21 | 0 | 0.157 |
| 97 | 58 | 35 | 15 | 0 | 0 | 0 | 0.169 |
| 98 | 58 | 35 | 15 | 72 | 0 | 0 | 0.169 |
| 99 | 58 | 35 | 15 | 144 | 0 | 0 | 0.169 |

-continued

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 100 | 58 | 35 | 15 | 216 | 0 | 0 | 0.169 |
| 101 | 58 | 35 | 15 | 288 | 0 | 0 | 0.169 |
| 102 | 58 | 39 | 15 | 36 | 0 | 0 | 0.145 |
| 103 | 58 | 39 | 15 | 108 | 0 | 0 | 0.145 |
| 104 | 58 | 39 | 15 | 180 | 0 | 0 | 0.145 |
| 105 | 58 | 39 | 15 | 252 | 0 | 0 | 0.145 |
| 106 | 58 | 39 | 15 | 324 | 0 | 0 | 0.145 |
| 107 | 63 | 51 | 30 | 26 | 25 | 15 | 0.145 |
| 108 | 63 | 51 | 30 | 45 | 34 | 45 | 0.145 |
| 109 | 63 | 51 | 30 | 98 | 25 | 15 | 0.145 |
| 110 | 63 | 51 | 30 | 117 | 34 | 45 | 0.145 |
| 111 | 63 | 51 | 30 | 170 | 25 | 15 | 0.145 |
| 112 | 63 | 51 | 30 | 189 | 34 | 45 | 0.145 |
| 113 | 63 | 51 | 30 | 242 | 25 | 15 | 0.145 |
| 114 | 63 | 51 | 30 | 261 | 34 | 45 | 0.145 |
| 115 | 63 | 51 | 30 | 314 | 25 | 15 | 0.145 |
| 116 | 63 | 51 | 30 | 333 | 34 | 45 | 0.145 |
| 117 | 67 | 4 | 30 | 16 | 5 | 30 | 0.145 |
| 118 | 67 | 4 | 30 | 55 | 54 | 30 | 0.145 |
| 119 | 67 | 4 | 30 | 88 | 5 | 30 | 0.145 |
| 120 | 67 | 4 | 30 | 127 | 54 | 30 | 0.145 |
| 121 | 67 | 4 | 30 | 160 | 5 | 30 | 0.145 |
| 122 | 67 | 4 | 30 | 199 | 54 | 30 | 0.145 |
| 123 | 67 | 4 | 30 | 232 | 5 | 30 | 0.145 |
| 124 | 67 | 4 | 30 | 271 | 54 | 30 | 0.145 |
| 125 | 67 | 4 | 30 | 304 | 5 | 30 | 0.145 |
| 126 | 67 | 4 | 30 | 343 | 54 | 30 | 0.145 |
| 127 | 67 | 56 | 0 | 5 | 39 | 0 | 0.145 |
| 128 | 67 | 56 | 0 | 66 | 21 | 0 | 0.145 |
| 129 | 67 | 56 | 0 | 77 | 39 | 0 | 0.145 |
| 130 | 67 | 56 | 0 | 138 | 21 | 0 | 0.145 |
| 131 | 67 | 56 | 0 | 149 | 39 | 0 | 0.145 |
| 132 | 67 | 56 | 0 | 210 | 21 | 0 | 0.145 |
| 133 | 67 | 56 | 0 | 221 | 39 | 0 | 0.145 |
| 134 | 67 | 56 | 0 | 282 | 21 | 0 | 0.145 |
| 135 | 67 | 56 | 0 | 283 | 39 | 0 | 0.145 |
| 136 | 67 | 56 | 0 | 354 | 21 | 0 | 0.145 |
| 137 | 68 | 20 | 30 | 36 | 0 | 0 | 0.145 |
| 138 | 68 | 20 | 30 | 108 | 0 | 0 | 0.145 |
| 139 | 68 | 20 | 30 | 180 | 0 | 0 | 0.145 |
| 140 | 68 | 20 | 30 | 252 | 0 | 0 | 0.145 |
| 141 | 68 | 20 | 30 | 324 | 0 | 0 | 0.145 |
| 142 | 76 | 14 | 0 | 20 | 20 | 0 | 0.145 |
| 143 | 76 | 14 | 0 | 51 | 40 | 0 | 0.145 |
| 144 | 76 | 14 | 0 | 92 | 20 | 0 | 0.145 |
| 145 | 76 | 14 | 0 | 123 | 40 | 0 | 0.145 |
| 146 | 76 | 14 | 0 | 164 | 20 | 0 | 0.145 |
| 147 | 76 | 14 | 0 | 195 | 40 | 0 | 0.145 |
| 148 | 76 | 14 | 0 | 236 | 20 | 0 | 0.145 |
| 149 | 76 | 14 | 0 | 267 | 40 | 0 | 0.145 |
| 150 | 76 | 14 | 0 | 308 | 20 | 0 | 0.145 |
| 151 | 76 | 14 | 0 | 339 | 40 | 0 | 0.145 |
| 152 | 76 | 25 | 45 | 0 | 0 | 0 | 0.145 |
| 153 | 76 | 25 | 45 | 72 | 0 | 0 | 0.145 |
| 154 | 76 | 25 | 45 | 144 | 0 | 0 | 0.145 |
| 155 | 76 | 25 | 45 | 216 | 0 | 0 | 0.145 |
| 156 | 76 | 25 | 45 | 288 | 0 | 0 | 0.145 |
| 157 | 76 | 26 | 15 | 30 | 22 | 15 | 0.145 |
| 158 | 76 | 26 | 15 | 41 | 37 | 45 | 0.145 |
| 159 | 76 | 26 | 15 | 102 | 22 | 15 | 0.145 |
| 160 | 76 | 26 | 15 | 113 | 37 | 45 | 0.145 |
| 161 | 76 | 26 | 15 | 174 | 22 | 15 | 0.145 |
| 162 | 76 | 26 | 15 | 185 | 37 | 45 | 0.145 |
| 163 | 76 | 26 | 15 | 246 | 22 | 15 | 0.145 |
| 164 | 76 | 26 | 15 | 257 | 37 | 45 | 0.145 |
| 165 | 76 | 26 | 15 | 318 | 22 | 15 | 0.145 |
| 166 | 76 | 26 | 15 | 329 | 37 | 45 | 0.145 |
| 167 | 76 | 42 | 45 | 10 | 18 | 0 | 0.145 |
| 168 | 76 | 42 | 45 | 82 | 18 | 0 | 0.145 |
| 169 | 76 | 42 | 45 | 154 | 18 | 0 | 0.145 |
| 170 | 76 | 42 | 45 | 226 | 18 | 0 | 0.145 |
| 171 | 76 | 42 | 45 | 298 | 18 | 0 | 0.145 |
| 172 | 76 | 43 | 15 | 61 | 42 | 0 | 0.145 |
| 173 | 76 | 43 | 15 | 133 | 42 | 0 | 0.145 |
| 174 | 76 | 43 | 15 | 205 | 42 | 0 | 0.145 |
| 175 | 76 | 43 | 15 | 277 | 42 | 0 | 0.145 |

-continued

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 176 | 76 | 43 | 15 | 349 | 42 | 0 | 0.145 |
| 177 | 85 | 1 | 15 | 5 | 8 | 30 | 0.145 |
| 178 | 85 | 1 | 15 | 15 | 25 | 45 | 0.145 |
| 179 | 85 | 1 | 15 | 25 | 42 | 45 | 0.145 |
| 180 | 85 | 1 | 15 | 36 | 0 | 0 | 0.145 |
| 181 | 85 | 1 | 15 | 46 | 17 | 15 | 0.145 |
| 182 | 85 | 1 | 15 | 56 | 34 | 15 | 0.145 |
| 183 | 85 | 1 | 15 | 66 | 51 | 30 | 0.145 |
| 184 | 85 | 1 | 15 | 77 | 8 | 30 | 0.145 |
| 185 | 85 | 1 | 15 | 87 | 25 | 45 | 0.145 |
| 186 | 85 | 1 | 15 | 97 | 42 | 45 | 0.145 |
| 187 | 85 | 1 | 15 | 108 | 0 | 0 | 0.145 |
| 188 | 85 | 1 | 15 | 118 | 17 | 15 | 0.145 |
| 189 | 85 | 1 | 15 | 128 | 34 | 15 | 0.145 |
| 190 | 85 | 1 | 15 | 138 | 51 | 30 | 0.145 |
| 191 | 85 | 1 | 15 | 149 | 8 | 30 | 0.145 |
| 192 | 85 | 1 | 15 | 159 | 25 | 45 | 0.145 |
| 193 | 85 | 1 | 15 | 169 | 42 | 45 | 0.145 |
| 194 | 85 | 1 | 15 | 180 | 0 | 0 | 0.145 |
| 195 | 85 | 1 | 15 | 190 | 17 | 15 | 0.145 |
| 196 | 85 | 1 | 15 | 200 | 34 | 15 | 0.145 |
| 197 | 85 | 1 | 15 | 210 | 51 | 30 | 0.145 |
| 198 | 85 | 1 | 15 | 221 | 8 | 30 | 0.145 |
| 199 | 85 | 1 | 15 | 231 | 25 | 45 | 0.145 |
| 200 | 85 | 1 | 15 | 241 | 42 | 45 | 0.145 |
| 201 | 85 | 1 | 15 | 252 | 0 | 0 | 0.145 |
| 202 | 85 | 1 | 15 | 262 | 17 | 15 | 0.145 |
| 203 | 85 | 1 | 15 | 272 | 34 | 15 | 0.145 |
| 204 | 85 | 1 | 15 | 282 | 51 | 30 | 0.145 |
| 205 | 85 | 1 | 15 | 293 | 8 | 30 | 0.145 |
| 206 | 85 | 1 | 15 | 303 | 25 | 45 | 0.145 |
| 207 | 85 | 1 | 15 | 313 | 42 | 45 | 0.145 |
| 208 | 85 | 1 | 15 | 324 | 0 | 0 | 0.145 |
| 209 | 85 | 1 | 15 | 334 | 17 | 15 | 0.145 |
| 210 | 85 | 1 | 15 | 344 | 34 | 15 | 0.145 |
| 211 | 85 | 1 | 15 | 354 | 51 | 30 | 0.145 |

Yet another ball which uses the same basic pattern and dimple diameter of FIGS. 3 and 4 is modified as to dimple depth. The dimples on this ball have the same coordinates as the ball of FIGS. 2 and 3. In this ball, 222 of the smallest diameter dimples nearest the poles have a depth of 0.0106 inch and the remaining 140 of the smallest diameter dimples have a depth of 0.0096 inch. This modification provides a coverage with no dimple overlap while maintaining a 78.4% coverage of the surface area of the ball. The weighted average dimple diameter for this ball is 0.1478 inch and the weighted average dimple depth is 0.01058 inch.

Figure 5:
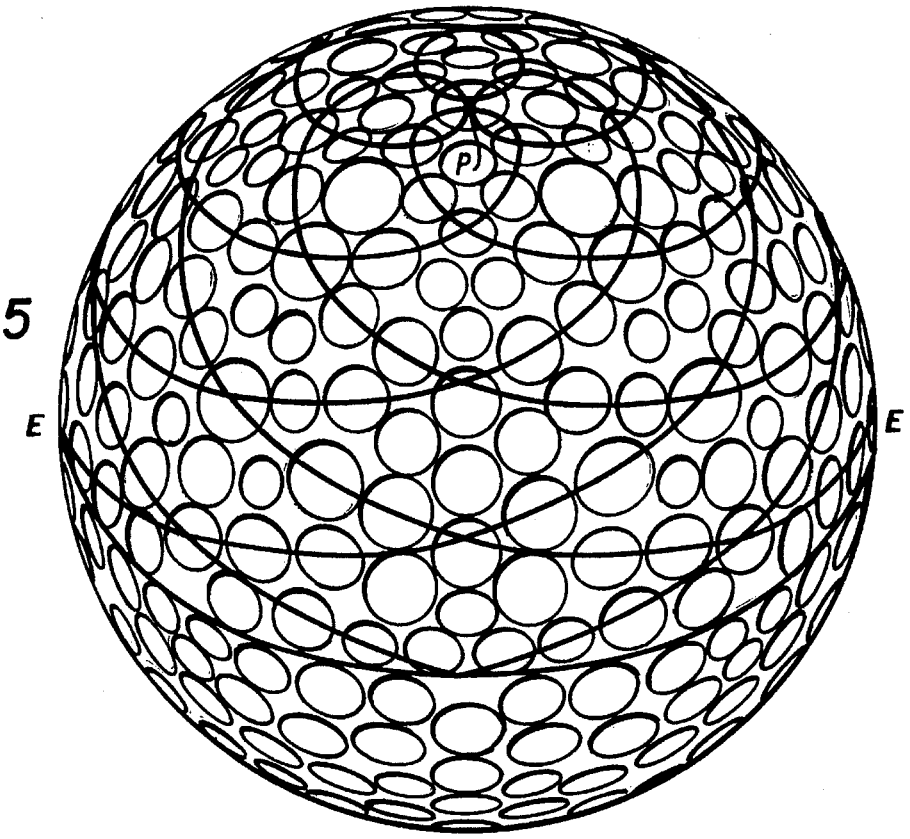
FIG. 5 is a modified dimple pattern of the present invention.

A further modification is shown in FIG. 5. This golf ball has 410 dimples comprising 138 dimples having a diameter of 0.169 inch and a depth of 0.0116 inch, 160 dimples having a diameter of 0.143 inch and a depth of 0.0101 inch, and 112 dimples having a diameter of 0.112 inch and a depth of 0.0077 inch. The configuration of the dimples comprises a dimple-free equatorial line E—E dividing the ball into two hemispheres having substantially identical dimple patterns. The dimple pattern of each hemisphere comprises a first plurality of dimples extending in four spaced clockwise arcs between the pole and the equator of each hemisphere, a second plurality of dimples extending in four spaced counterclockwise arcs between the pole and equator of each hemisphere, and a third plurality of dimples filling the surface area between the first and second plurality of dimples. In this ball, none of the dimples overlap. This pattern provides a weighted average dimple diameter of 0.1433 inch, a weighted average dimple depth of 0.010 inch, and a 73.1% coverage of the surface of the ball.

There follows the coordinates of the 410 dimple pattern ball:

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 1 | 0 | 0 | 0 | 0 | 0 | 0 | 0.169 |
| 2 | 11 | 53 | 30 | 0 | 0 | 0 | 0.112 |
| 3 | 11 | 53 | 30 | 45 | 0 | 0 | 0.143 |
| 4 | 11 | 53 | 30 | 90 | 0 | 0 | 0.112 |
| 5 | 11 | 53 | 30 | 135 | 0 | 0 | 0.143 |
| 6 | 11 | 53 | 30 | 180 | 0 | 0 | 0.112 |
| 7 | 11 | 53 | 30 | 225 | 0 | 0 | 0.143 |
| 8 | 11 | 53 | 30 | 270 | 0 | 0 | 0.112 |
| 9 | 11 | 53 | 30 | 315 | 0 | 0 | 0.143 |
| 10 | 18 | 32 | 0 | 19 | 6 | 45 | 0.112 |
| 11 | 18 | 32 | 0 | 70 | 53 | 15 | 0.112 |

-continued

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 12 | 18 | 32 | 0 | 109 | 6 | 45 | 0.112 |
| 13 | 18 | 32 | 0 | 160 | 53 | 15 | 0.112 |
| 14 | 18 | 32 | 0 | 199 | 6 | 45 | 0.112 |
| 15 | 18 | 32 | 0 | 250 | 53 | 15 | 0.112 |
| 16 | 18 | 32 | 0 | 289 | 6 | 45 | 0.112 |
| 17 | 18 | 32 | 0 | 340 | 53 | 15 | 0.112 |
| 18 | 22 | 24 | 0 | 45 | 0 | 0 | 0.169 |
| 19 | 22 | 24 | 0 | 135 | 0 | 0 | 0.169 |
| 20 | 22 | 24 | 0 | 225 | 0 | 0 | 0.169 |
| 21 | 22 | 24 | 0 | 315 | 0 | 0 | 0.169 |
| 22 | 23 | 27 | 45 | 0 | 0 | 0 | 0.112 |
| 23 | 23 | 27 | 45 | 90 | 0 | 0 | 0.112 |
| 24 | 23 | 27 | 45 | 180 | 0 | 0 | 0.112 |
| 25 | 23 | 27 | 45 | 270 | 0 | 0 | 0.112 |
| 26 | 28 | 45 | 15 | 25 | 39 | 0 | 0.143 |
| 27 | 28 | 45 | 15 | 64 | 21 | 0 | 0.143 |
| 28 | 28 | 45 | 15 | 115 | 39 | 0 | 0.143 |
| 29 | 28 | 45 | 15 | 154 | 21 | 0 | 0.143 |
| 30 | 28 | 45 | 15 | 205 | 39 | 0 | 0.143 |
| 31 | 28 | 45 | 15 | 244 | 21 | 0 | 0.143 |
| 32 | 28 | 45 | 15 | 295 | 39 | 0 | 0.143 |
| 33 | 28 | 45 | 15 | 334 | 21 | 0 | 0.143 |
| 34 | 30 | 53 | 45 | 8 | 17 | 0 | 0.112 |
| 35 | 30 | 53 | 45 | 81 | 43 | 0 | 0.112 |
| 36 | 30 | 53 | 45 | 98 | 17 | 0 | 0.112 |
| 37 | 30 | 53 | 45 | 171 | 43 | 0 | 0.112 |
| 38 | 30 | 53 | 45 | 188 | 17 | 0 | 0.112 |
| 39 | 30 | 53 | 45 | 261 | 43 | 0 | 0.112 |
| 40 | 30 | 53 | 45 | 278 | 17 | 0 | 0.112 |
| 41 | 30 | 53 | 45 | 351 | 43 | 0 | 0.112 |
| 42 | 33 | 55 | 45 | 45 | 0 | 0 | 0.169 |
| 43 | 33 | 55 | 45 | 135 | 0 | 0 | 0.169 |
| 44 | 33 | 55 | 45 | 225 | 0 | 0 | 0.169 |
| 45 | 33 | 55 | 45 | 315 | 0 | 0 | 0.169 |
| 46 | 37 | 40 | 15 | 0 | 0 | 0 | 0.112 |
| 47 | 37 | 40 | 15 | 90 | 0 | 0 | 0.112 |
| 48 | 37 | 40 | 15 | 180 | 0 | 0 | 0.112 |
| 49 | 37 | 40 | 15 | 270 | 0 | 0 | 0.112 |
| 50 | 38 | 13 | 15 | 28 | 43 | 0 | 0.143 |
| 51 | 38 | 13 | 15 | 61 | 17 | 0 | 0.143 |
| 52 | 38 | 13 | 15 | 118 | 43 | 0 | 0.143 |
| 53 | 38 | 13 | 15 | 151 | 17 | 0 | 0.143 |
| 54 | 38 | 13 | 15 | 208 | 43 | 0 | 0.143 |
| 55 | 38 | 13 | 15 | 241 | 17 | 0 | 0.143 |
| 56 | 38 | 13 | 15 | 298 | 43 | 0 | 0.143 |
| 57 | 38 | 13 | 15 | 331 | 17 | 0 | 0.143 |
| 58 | 41 | 7 | 30 | 13 | 57 | 0 | 0.143 |
| 59 | 41 | 7 | 30 | 76 | 3 | 0 | 0.143 |
| 60 | 41 | 7 | 30 | 103 | 57 | 0 | 0.143 |
| 61 | 41 | 7 | 30 | 166 | 3 | 0 | 0.143 |
| 62 | 41 | 7 | 30 | 193 | 57 | 0 | 0.143 |
| 63 | 41 | 7 | 30 | 256 | 3 | 0 | 0.143 |
| 64 | 41 | 7 | 30 | 283 | 57 | 0 | 0.143 |
| 65 | 41 | 7 | 30 | 346 | 3 | 0 | 0.143 |
| 66 | 44 | 31 | 0 | 39 | 0 | 15 | 0.112 |
| 67 | 44 | 31 | 0 | 50 | 59 | 45 | 0.112 |
| 68 | 44 | 31 | 0 | 129 | 0 | 15 | 0.112 |
| 69 | 44 | 31 | 0 | 140 | 59 | 45 | 0.112 |
| 70 | 44 | 31 | 0 | 219 | 0 | 15 | 0.112 |
| 71 | 44 | 31 | 0 | 230 | 59 | 45 | 0.112 |
| 72 | 44 | 31 | 0 | 309 | 0 | 15 | 0.112 |
| 73 | 44 | 31 | 0 | 320 | 59 | 45 | 0.112 |
| 74 | 47 | 47 | 15 | 0 | 0 | 0 | 0.143 |
| 75 | 47 | 47 | 15 | 90 | 0 | 0 | 0.143 |
| 76 | 47 | 47 | 15 | 180 | 0 | 0 | 0.143 |
| 77 | 47 | 47 | 15 | 270 | 0 | 0 | 0.143 |
| 78 | 49 | 27 | 0 | 21 | 28 | 45 | 0.143 |
| 79 | 49 | 27 | 0 | 68 | 31 | 15 | 0.143 |
| 80 | 49 | 27 | 0 | 111 | 28 | 45 | 0.143 |
| 81 | 49 | 27 | 0 | 158 | 31 | 15 | 0.143 |
| 82 | 49 | 27 | 0 | 201 | 28 | 45 | 0.143 |
| 83 | 49 | 27 | 0 | 248 | 31 | 15 | 0.143 |
| 84 | 49 | 27 | 0 | 291 | 28 | 45 | 0.143 |
| 85 | 49 | 27 | 0 | 338 | 31 | 15 | 0.143 |
| 86 | 52 | 21 | 45 | 33 | 13 | 15 | 0.143 |
| 87 | 52 | 21 | 45 | 56 | 46 | 45 | 0.143 |

-continued

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 88 | 52 | 21 | 45 | 123 | 13 | 15 | 0.143 |
| 89 | 52 | 21 | 45 | 146 | 46 | 45 | 0.143 |
| 90 | 52 | 21 | 45 | 213 | 13 | 15 | 0.143 |
| 91 | 52 | 21 | 45 | 236 | 46 | 45 | 0.143 |
| 92 | 52 | 21 | 45 | 303 | 13 | 15 | 0.143 |
| 93 | 52 | 21 | 45 | 326 | 46 | 45 | 0.143 |
| 94 | 53 | 30 | 15 | 10 | 15 | 45 | 0.143 |
| 95 | 53 | 30 | 15 | 79 | 44 | 15 | 0.143 |
| 96 | 53 | 30 | 15 | 100 | 15 | 45 | 0.143 |
| 97 | 53 | 30 | 15 | 169 | 44 | 15 | 0.143 |
| 98 | 53 | 30 | 15 | 190 | 15 | 45 | 0.143 |
| 99 | 53 | 30 | 15 | 259 | 44 | 15 | 0.143 |
| 100 | 53 | 30 | 15 | 280 | 15 | 45 | 0.143 |
| 101 | 53 | 30 | 15 | 349 | 44 | 15 | 0.143 |
| 102 | 56 | 28 | 15 | 45 | 0 | 0 | 0.169 |
| 103 | 56 | 28 | 15 | 135 | 0 | 0 | 0.169 |
| 104 | 56 | 28 | 15 | 225 | 0 | 0 | 0.169 |
| 105 | 56 | 28 | 15 | 315 | 0 | 0 | 0.169 |
| 106 | 58 | 51 | 0 | 0 | 0 | 0 | 0.143 |
| 107 | 58 | 51 | 0 | 90 | 0 | 0 | 0.143 |
| 108 | 58 | 51 | 0 | 180 | 0 | 0 | 0.143 |
| 109 | 58 | 51 | 0 | 270 | 0 | 0 | 0.143 |
| 110 | 61 | 8 | 30 | 24 | 2 | 0 | 0.169 |
| 111 | 61 | 8 | 30 | 65 | 58 | 0 | 0.169 |
| 112 | 61 | 8 | 30 | 114 | 2 | 0 | 0.169 |
| 113 | 61 | 8 | 30 | 155 | 58 | 0 | 0.169 |
| 114 | 61 | 8 | 30 | 204 | 2 | 0 | 0.169 |
| 115 | 61 | 8 | 30 | 245 | 58 | 0 | 0.169 |
| 116 | 61 | 8 | 30 | 294 | 2 | 0 | 0.169 |
| 117 | 61 | 8 | 30 | 335 | 58 | 0 | 0.169 |
| 118 | 64 | 13 | 0 | 11 | 20 | 30 | 0.169 |
| 119 | 64 | 13 | 0 | 78 | 39 | 30 | 0.169 |
| 120 | 64 | 13 | 0 | 101 | 20 | 30 | 0.169 |
| 121 | 64 | 13 | 0 | 168 | 39 | 30 | 0.169 |
| 122 | 64 | 13 | 0 | 191 | 20 | 30 | 0.169 |
| 123 | 64 | 13 | 0 | 258 | 39 | 30 | 0.169 |
| 124 | 64 | 13 | 0 | 281 | 20 | 30 | 0.169 |
| 125 | 64 | 13 | 0 | 348 | 39 | 30 | 0.169 |
| 126 | 65 | 4 | 15 | 34 | 34 | 15 | 0.112 |
| 127 | 65 | 4 | 15 | 55 | 25 | 45 | 0.112 |
| 128 | 65 | 4 | 15 | 124 | 34 | 15 | 0.112 |
| 129 | 65 | 4 | 15 | 145 | 25 | 45 | 0.112 |
| 130 | 65 | 4 | 15 | 214 | 34 | 15 | 0.112 |
| 131 | 65 | 4 | 15 | 235 | 25 | 45 | 0.112 |
| 132 | 65 | 4 | 15 | 304 | 34 | 15 | 0.112 |
| 133 | 65 | 4 | 15 | 325 | 25 | 45 | 0.112 |
| 134 | 67 | 50 | 15 | 45 | 0 | 0 | 0.169 |
| 135 | 67 | 50 | 15 | 135 | 0 | 0 | 0.169 |
| 136 | 67 | 50 | 15 | 225 | 0 | 0 | 0.169 |
| 137 | 67 | 50 | 15 | 315 | 0 | 0 | 0.169 |
| 138 | 69 | 25 | 30 | 0 | 0 | 0 | 0.143 |
| 139 | 69 | 25 | 30 | 90 | 0 | 0 | 0.143 |
| 140 | 69 | 25 | 30 | 180 | 0 | 0 | 0.143 |
| 141 | 69 | 25 | 30 | 270 | 0 | 0 | 0.143 |
| 142 | 72 | 42 | 30 | 21 | 18 | 0 | 0.169 |
| 143 | 72 | 42 | 30 | 68 | 42 | 0 | 0.169 |
| 144 | 72 | 42 | 30 | 111 | 18 | 0 | 0.169 |
| 145 | 72 | 42 | 30 | 158 | 42 | 0 | 0.169 |
| 146 | 72 | 42 | 30 | 201 | 18 | 0 | 0.169 |
| 147 | 72 | 42 | 30 | 248 | 42 | 0 | 0.169 |
| 148 | 72 | 42 | 30 | 291 | 18 | 0 | 0.169 |
| 149 | 72 | 42 | 30 | 338 | 42 | 0 | 0.169 |
| 150 | 74 | 42 | 0 | 33 | 5 | 0 | 0.169 |
| 151 | 74 | 42 | 0 | 56 | 55 | 0 | 0.169 |
| 152 | 74 | 42 | 0 | 123 | 5 | 0 | 0.169 |
| 153 | 74 | 42 | 0 | 146 | 55 | 0 | 0.169 |
| 154 | 74 | 42 | 0 | 213 | 5 | 0 | 0.169 |
| 155 | 74 | 42 | 0 | 236 | 55 | 0 | 0.169 |
| 156 | 74 | 42 | 0 | 303 | 5 | 0 | 0.169 |
| 157 | 74 | 42 | 0 | 326 | 55 | 0 | 0.169 |
| 158 | 75 | 34 | 0 | 9 | 26 | 30 | 0.169 |
| 159 | 75 | 34 | 0 | 80 | 33 | 30 | 0.169 |
| 160 | 75 | 34 | 0 | 99 | 26 | 30 | 0.169 |
| 161 | 75 | 34 | 0 | 170 | 33 | 30 | 0.169 |
| 162 | 75 | 34 | 0 | 189 | 26 | 30 | 0.169 |
| 163 | 75 | 34 | 0 | 260 | 33 | 30 | 0.169 |

-continued

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 164 | 75 | 34 | 0 | 279 | 26 | 30 | 0.169 |
| 165 | 75 | 34 | 0 | 350 | 33 | 30 | 0.169 |
| 166 | 79 | 8 | 15 | 45 | 0 | 0 | 0.169 |
| 167 | 79 | 8 | 15 | 135 | 0 | 0 | 0.169 |
| 168 | 79 | 8 | 15 | 225 | 0 | 0 | 0.169 |
| 169 | 79 | 8 | 15 | 315 | 0 | 0 | 0.169 |
| 170 | 79 | 18 | 0 | 0 | 0 | 0 | 0.112 |
| 171 | 79 | 18 | 0 | 90 | 0 | 0 | 0.112 |
| 172 | 79 | 18 | 0 | 180 | 0 | 0 | 0.112 |
| 173 | 79 | 18 | 0 | 270 | 0 | 0 | 0.112 |
| 174 | 83 | 47 | 15 | 24 | 36 | 45 | 0.169 |
| 175 | 83 | 47 | 15 | 65 | 23 | 15 | 0.169 |
| 176 | 83 | 47 | 15 | 114 | 36 | 45 | 0.169 |
| 177 | 83 | 47 | 15 | 155 | 23 | 15 | 0.169 |
| 178 | 83 | 47 | 15 | 204 | 36 | 45 | 0.169 |
| 179 | 83 | 47 | 15 | 245 | 23 | 15 | 0.169 |
| 180 | 83 | 47 | 15 | 294 | 36 | 45 | 0.169 |
| 181 | 83 | 47 | 15 | 335 | 23 | 15 | 0.169 |
| 182 | 84 | 46 | 45 | 35 | 54 | 15 | 0.143 |
| 183 | 84 | 46 | 45 | 54 | 5 | 45 | 0.143 |
| 184 | 84 | 46 | 45 | 125 | 54 | 15 | 0.143 |
| 185 | 84 | 46 | 45 | 144 | 5 | 45 | 0.143 |
| 186 | 84 | 46 | 45 | 215 | 54 | 15 | 0.143 |
| 187 | 84 | 46 | 45 | 234 | 5 | 45 | 0.143 |
| 188 | 84 | 46 | 45 | 305 | 54 | 15 | 0.143 |
| 189 | 84 | 46 | 45 | 324 | 5 | 45 | 0.143 |
| 190 | 85 | 0 | 15 | 14 | 6 | 30 | 0.143 |
| 191 | 85 | 0 | 15 | 75 | 53 | 30 | 0.143 |
| 192 | 85 | 0 | 15 | 104 | 6 | 30 | 0.143 |
| 193 | 85 | 0 | 15 | 165 | 53 | 30 | 0.143 |
| 194 | 85 | 0 | 15 | 194 | 6 | 30 | 0.143 |
| 195 | 85 | 0 | 15 | 255 | 53 | 30 | 0.143 |
| 196 | 85 | 0 | 15 | 284 | 6 | 30 | 0.143 |
| 197 | 85 | 0 | 15 | 345 | 53 | 30 | 0.143 |
| 198 | 85 | 39 | 15 | 4 | 54 | 15 | 0.112 |
| 199 | 85 | 39 | 15 | 85 | 5 | 45 | 0.112 |
| 200 | 85 | 39 | 15 | 94 | 54 | 15 | 0.112 |
| 201 | 85 | 39 | 15 | 175 | 5 | 45 | 0.112 |
| 202 | 85 | 39 | 15 | 184 | 54 | 15 | 0.112 |
| 203 | 85 | 39 | 15 | 265 | 5 | 45 | 0.112 |
| 204 | 85 | 39 | 15 | 274 | 54 | 15 | 0.112 |
| 205 | 85 | 39 | 15 | 355 | 5 | 45 | 0.112 |

Figure 6:
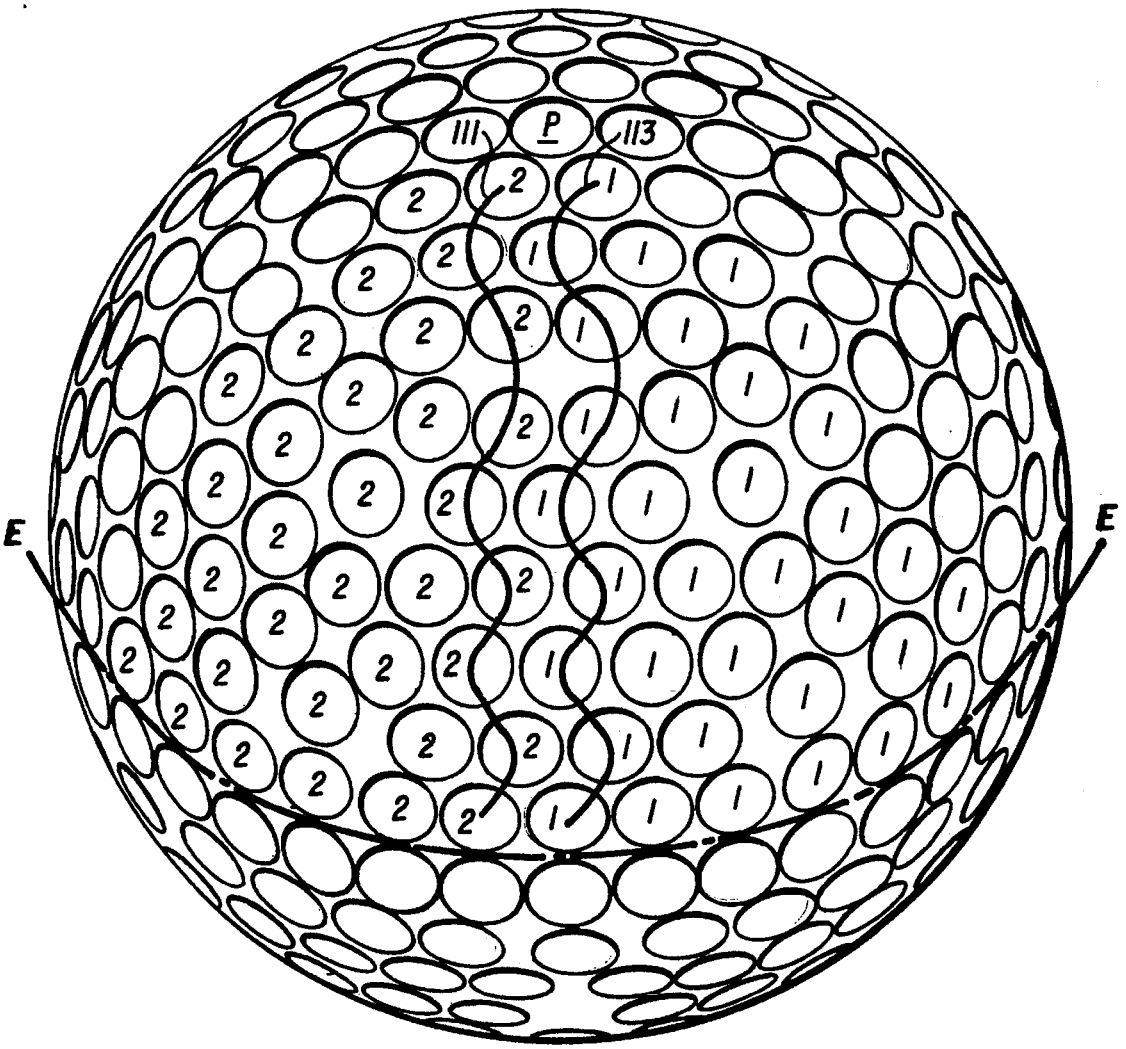
FIG. 6 is a further modified dimple pattern of the present invention.

A still further modification is shown in FIG. 6. This golf ball has 422 dimples, all dimples having the same diameter of 0.143 inch and the same depth of 0.0103 inch. The dimples are arranged in a configuration so as to provide a dimple-free equatorial line, with each hemisphere of the ball having six identical dimpled substantially mating sections with a common dimple at each pole. FIG. 6 shows two mating sections having dimples 1 and 2, respectively. Each section comprises six dimples lying substantially along a line parallel with but spaced from the equatorial line, 29 dimples between the six dimples and the common polar dimple, with the outer dimples of each of said sections lying on modified sinusoidal lines 113 and 115.

Since only one diameter is used for all dimples, some small percentage of overlap occurs in order to provide substantial surface coverage with the dimples. For this particular pattern, there is an 11.4% (48) dimple overlap with a 73.2% coverage of the surface area of the ball. Overlap is determined by finding the number of dimples having an edge overlapping any other dimple and dividing that number by the total number of dimples on the ball, such number being expressed as a percentage.

There follows the coordinates for the dimple pattern of the 422 dimple ball having one size of dimples:

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 1 | 0 | 0 | 0 | 30 | 0 | 0 | 0.143 |
| 2 | 10 | 25 | 0 | 30 | 0 | 0 | 0.143 |
| 3 | 10 | 25 | 0 | 90 | 0 | 0 | 0.143 |
| 4 | 10 | 25 | 0 | 150 | 0 | 0 | 0.143 |
| 5 | 10 | 25 | 0 | 210 | 0 | 0 | 0.143 |
| 6 | 10 | 25 | 0 | 270 | 0 | 0 | 0.143 |
| 7 | 10 | 25 | 0 | 330 | 0 | 0 | 0.143 |
| 8 | 18 | 17 | 45 | 0 | 0 | 0 | 0.143 |
| 9 | 18 | 17 | 45 | 60 | 0 | 0 | 0.143 |

-continued

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 10 | 18 | 17 | 45 | 120 | 0 | 0 | 0.143 |
| 11 | 18 | 17 | 45 | 180 | 0 | 0 | 0.143 |
| 12 | 18 | 17 | 45 | 240 | 0 | 0 | 0.143 |
| 13 | 18 | 17 | 45 | 300 | 0 | 0 | 0.143 |
| 14 | 20 | 49 | 45 | 30 | 0 | 0 | 0.143 |
| 15 | 20 | 49 | 45 | 90 | 0 | 0 | 0.143 |
| 16 | 20 | 49 | 45 | 150 | 0 | 0 | 0.143 |
| 17 | 20 | 49 | 45 | 210 | 0 | 0 | 0.143 |
| 18 | 20 | 49 | 45 | 270 | 0 | 0 | 0.143 |
| 19 | 20 | 49 | 45 | 330 | 0 | 0 | 0.143 |
| 20 | 27 | 43 | 15 | 49 | 19 | 0 | 0.143 |
| 21 | 27 | 43 | 15 | 109 | 19 | 0 | 0.143 |
| 22 | 27 | 43 | 15 | 169 | 19 | 0 | 0.143 |
| 23 | 27 | 43 | 15 | 229 | 19 | 0 | 0.143 |
| 24 | 27 | 43 | 15 | 289 | 19 | 0 | 0.143 |
| 25 | 27 | 43 | 15 | 349 | 19 | 0 | 0.143 |
| 26 | 27 | 43 | 30 | 10 | 40 | 45 | 0.143 |
| 27 | 27 | 43 | 30 | 70 | 40 | 45 | 0.143 |
| 28 | 27 | 43 | 30 | 130 | 40 | 45 | 0.143 |
| 29 | 27 | 43 | 30 | 190 | 40 | 45 | 0.143 |
| 30 | 27 | 43 | 30 | 250 | 40 | 45 | 0.143 |
| 31 | 27 | 43 | 30 | 310 | 40 | 45 | 0.143 |
| 32 | 30 | 48 | 45 | 30 | 0 | 0 | 0.143 |
| 33 | 30 | 48 | 45 | 90 | 0 | 0 | 0.143 |
| 34 | 30 | 48 | 45 | 150 | 0 | 0 | 0.143 |
| 35 | 30 | 48 | 45 | 210 | 0 | 0 | 0.143 |
| 36 | 30 | 48 | 45 | 270 | 0 | 0 | 0.143 |
| 37 | 30 | 48 | 45 | 330 | 0 | 0 | 0.143 |
| 38 | 39 | 25 | 30 | 7 | 34 | 30 | 0.143 |
| 39 | 39 | 25 | 30 | 52 | 25 | 30 | 0.143 |
| 40 | 39 | 25 | 30 | 67 | 34 | 30 | 0.143 |
| 41 | 39 | 25 | 30 | 112 | 25 | 30 | 0.143 |
| 42 | 39 | 25 | 30 | 127 | 34 | 30 | 0.143 |
| 43 | 39 | 25 | 30 | 172 | 25 | 30 | 0.143 |
| 44 | 39 | 25 | 30 | 187 | 34 | 30 | 0.143 |
| 45 | 39 | 25 | 30 | 232 | 25 | 30 | 0.143 |
| 46 | 39 | 25 | 30 | 247 | 34 | 30 | 0.143 |
| 47 | 39 | 25 | 30 | 292 | 25 | 30 | 0.143 |
| 48 | 39 | 25 | 30 | 307 | 34 | 30 | 0.143 |
| 49 | 39 | 25 | 30 | 352 | 25 | 30 | 0.143 |
| 50 | 39 | 39 | 15 | 22 | 13 | 30 | 0.143 |
| 51 | 39 | 39 | 15 | 82 | 13 | 30 | 0.143 |
| 52 | 39 | 39 | 15 | 142 | 13 | 30 | 0.143 |
| 53 | 39 | 39 | 15 | 202 | 13 | 30 | 0.143 |
| 54 | 39 | 39 | 15 | 262 | 13 | 30 | 0.143 |
| 55 | 39 | 39 | 15 | 322 | 13 | 30 | 0.143 |
| 56 | 39 | 39 | 15 | 37 | 46 | 30 | 0.143 |
| 57 | 39 | 39 | 15 | 97 | 46 | 30 | 0.143 |
| 58 | 39 | 39 | 15 | 157 | 46 | 30 | 0.143 |
| 59 | 39 | 39 | 15 | 217 | 46 | 30 | 0.143 |
| 60 | 39 | 39 | 15 | 277 | 46 | 30 | 0.143 |
| 61 | 39 | 39 | 15 | 337 | 46 | 30 | 0.143 |
| 62 | 48 | 35 | 15 | 13 | 42 | 45 | 0.143 |
| 63 | 48 | 35 | 15 | 46 | 17 | 15 | 0.143 |
| 64 | 48 | 35 | 15 | 73 | 42 | 45 | 0.143 |
| 65 | 48 | 35 | 15 | 106 | 17 | 15 | 0.143 |
| 66 | 48 | 36 | 15 | 133 | 42 | 45 | 0.143 |
| 67 | 48 | 35 | 15 | 166 | 17 | 15 | 0.143 |
| 68 | 48 | 35 | 15 | 193 | 42 | 45 | 0.143 |
| 69 | 48 | 35 | 15 | 226 | 17 | 15 | 0.143 |
| 70 | 48 | 35 | 15 | 253 | 42 | 45 | 0.143 |
| 71 | 48 | 35 | 15 | 286 | 17 | 15 | 0.143 |
| 72 | 48 | 35 | 15 | 313 | 42 | 45 | 0.143 |
| 73 | 48 | 35 | 15 | 346 | 17 | 15 | 0.143 |
| 74 | 49 | 19 | 0 | 60 | 0 | 0 | 0.143 |
| 75 | 49 | 19 | 0 | 120 | 0 | 0 | 0.143 |
| 76 | 49 | 19 | 0 | 180 | 0 | 0 | 0.143 |
| 77 | 49 | 19 | 0 | 240 | 0 | 0 | 0.143 |
| 78 | 49 | 19 | 0 | 300 | 0 | 0 | 0.143 |
| 79 | 49 | 19 | 0 | 360 | 0 | 0 | 0.143 |
| 80 | 49 | 40 | 30 | 30 | 0 | 0 | 0.143 |
| 81 | 49 | 40 | 30 | 90 | 0 | 0 | 0.143 |
| 82 | 49 | 40 | 30 | 150 | 0 | 0 | 0.143 |
| 83 | 49 | 40 | 30 | 210 | 0 | 0 | 0.143 |
| 84 | 49 | 40 | 30 | 270 | 0 | 0 | 0.143 |
| 85 | 49 | 40 | 30 | 330 | 0 | 0 | 0.143 |

-continued

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 86 | 58 | 1 | 30 | 18 | 41 | 30 | 0.143 |
| 87 | 58 | 1 | 30 | 41 | 18 | 30 | 0.143 |
| 88 | 58 | 1 | 30 | 78 | 41 | 30 | 0.143 |
| 89 | 58 | 1 | 30 | 101 | 18 | 30 | 0.143 |
| 90 | 58 | 1 | 30 | 138 | 41 | 30 | 0.143 |
| 91 | 58 | 1 | 30 | 161 | 18 | 30 | 0.143 |
| 92 | 58 | 1 | 30 | 198 | 41 | 30 | 0.143 |
| 93 | 58 | 1 | 30 | 221 | 18 | 30 | 0.143 |
| 94 | 58 | 1 | 30 | 258 | 41 | 30 | 0.143 |
| 95 | 58 | 1 | 30 | 281 | 18 | 30 | 0.143 |
| 96 | 58 | 1 | 30 | 318 | 41 | 30 | 0.143 |
| 97 | 58 | 1 | 30 | 341 | 18 | 30 | 0.143 |
| 98 | 58 | 4 | 15 | 6 | 6 | 15 | 0.143 |
| 99 | 58 | 4 | 15 | 53 | 53 | 45 | 0.143 |
| 100 | 58 | 14 | 15 | 66 | 6 | 15 | 0.143 |
| 101 | 58 | 14 | 15 | 113 | 53 | 45 | 0.143 |
| 102 | 58 | 14 | 15 | 126 | 6 | 15 | 0.143 |
| 103 | 58 | 14 | 15 | 173 | 53 | 45 | 0.143 |
| 104 | 58 | 14 | 15 | 186 | 6 | 15 | 0.143 |
| 105 | 58 | 14 | 15 | 233 | 53 | 45 | 0.143 |
| 106 | 58 | 14 | 15 | 246 | 6 | 15 | 0.143 |
| 107 | 58 | 14 | 15 | 293 | 53 | 45 | 0.143 |
| 108 | 58 | 14 | 15 | 306 | 6 | 15 | 0.143 |
| 109 | 58 | 14 | 15 | 353 | 53 | 45 | 0.143 |
| 110 | 60 | 8 | 15 | 30 | 0 | 0 | 0.143 |
| 111 | 60 | 8 | 15 | 90 | 0 | 0 | 0.143 |
| 112 | 50 | 8 | 15 | 150 | 0 | 0 | 0.143 |
| 113 | 60 | 8 | 15 | 210 | 0 | 0 | 0.143 |
| 114 | 60 | 8 | 15 | 270 | 0 | 0 | 0.143 |
| 115 | 60 | 8 | 15 | 330 | 0 | 0 | 0.143 |
| 116 | 67 | 3 | 0 | 11 | 19 | 15 | 0.143 |
| 117 | 67 | 3 | 0 | 48 | 40 | 45 | 0.143 |
| 118 | 67 | 3 | 0 | 71 | 19 | 15 | 0.143 |
| 119 | 67 | 3 | 0 | 108 | 40 | 45 | 0.143 |
| 120 | 67 | 3 | 0 | 131 | 19 | 15 | 0.143 |
| 121 | 67 | 3 | 0 | 168 | 40 | 45 | 0.143 |
| 122 | 67 | 3 | 0 | 191 | 19 | 15 | 0.143 |
| 123 | 67 | 3 | 0 | 228 | 40 | 45 | 0.143 |
| 124 | 67 | 3 | 0 | 251 | 19 | 15 | 0.143 |
| 125 | 67 | 3 | 0 | 288 | 40 | 45 | 0.143 |
| 126 | 67 | 3 | 0 | 311 | 19 | 15 | 0.143 |
| 127 | 67 | 3 | 0 | 348 | 40 | 45 | 0.143 |
| 128 | 67 | 15 | 45 | 0 | 0 | 0 | 0.143 |
| 129 | 67 | 15 | 45 | 60 | 0 | 0 | 0.143 |
| 130 | 67 | 15 | 45 | 120 | 0 | 0 | 0.143 |
| 131 | 67 | 15 | 45 | 180 | 0 | 0 | 0.143 |
| 132 | 67 | 15 | 45 | 240 | 0 | 0 | 0.143 |
| 133 | 67 | 15 | 45 | 300 | 0 | 0 | 0.143 |
| 134 | 67 | 39 | 30 | 22 | 36 | 30 | 0.143 |
| 135 | 67 | 39 | 30 | 37 | 23 | 30 | 0.143 |
| 136 | 67 | 39 | 30 | 82 | 36 | 30 | 0.143 |
| 137 | 67 | 39 | 30 | 97 | 23 | 30 | 0.143 |
| 138 | 67 | 39 | 30 | 142 | 36 | 30 | 0.143 |
| 139 | 67 | 39 | 30 | 157 | 23 | 30 | 0.143 |
| 140 | 67 | 39 | 30 | 202 | 36 | 30 | 0.143 |
| 141 | 67 | 39 | 30 | 217 | 23 | 30 | 0.143 |
| 142 | 67 | 39 | 30 | 262 | 36 | 30 | 0.143 |
| 143 | 67 | 39 | 30 | 277 | 23 | 30 | 0.143 |
| 144 | 67 | 39 | 30 | 322 | 36 | 30 | 0.143 |
| 145 | 67 | 39 | 30 | 337 | 23 | 30 | 0.143 |
| 146 | 74 | 20 | 30 | 30 | 0 | 0 | 0.143 |
| 147 | 74 | 20 | 30 | 90 | 0 | 0 | 0.143 |
| 148 | 74 | 20 | 30 | 150 | 0 | 0 | 0.143 |
| 149 | 74 | 20 | 30 | 210 | 0 | 0 | 0.143 |
| 150 | 74 | 20 | 30 | 270 | 0 | 0 | 0.143 |
| 151 | 74 | 20 | 30 | 330 | 0 | 0 | 0.143 |
| 152 | 75 | 54 | 0 | 5 | 20 | 45 | 0.143 |
| 153 | 75 | 54 | 0 | 54 | 39 | 15 | 0.143 |
| 154 | 75 | 54 | 0 | 65 | 20 | 45 | 0.143 |
| 155 | 75 | 54 | 0 | 114 | 39 | 15 | 0.143 |
| 156 | 75 | 54 | 0 | 125 | 20 | 45 | 0.143 |
| 157 | 75 | 54 | 0 | 174 | 39 | 15 | 0.143 |
| 158 | 75 | 54 | 0 | 185 | 20 | 45 | 0.143 |
| 159 | 75 | 54 | 0 | 234 | 39 | 15 | 0.143 |
| 160 | 75 | 54 | 0 | 245 | 20 | 45 | 0.143 |
| 161 | 75 | 54 | 0 | 294 | 39 | 15 | 0.143 |

-continued

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 162 | 75 | 54 | 0 | 305 | 20 | 45 | 0.143 |
| 163 | 75 | 54 | 0 | 354 | 39 | 15 | 0.143 |
| 164 | 75 | 57 | 0 | 16 | 16 | 30 | 0.143 |
| 165 | 75 | 57 | 0 | 43 | 43 | 30 | 0.143 |
| 166 | 75 | 57 | 0 | 76 | 16 | 30 | 0.143 |
| 167 | 75 | 57 | 0 | 103 | 43 | 30 | 0.143 |
| 168 | 75 | 57 | 0 | 136 | 16 | 30 | 0.143 |
| 169 | 75 | 57 | 0 | 163 | 43 | 30 | 0.143 |
| 170 | 75 | 57 | 0 | 196 | 16 | 30 | 0.143 |
| 171 | 75 | 57 | 0 | 223 | 43 | 30 | 0.143 |
| 172 | 75 | 57 | 0 | 256 | 16 | 30 | 0.143 |
| 173 | 75 | 57 | 0 | 283 | 43 | 30 | 0.143 |
| 174 | 75 | 57 | 0 | 316 | 16 | 30 | 0.143 |
| 175 | 75 | 57 | 0 | 343 | 43 | 30 | 0.143 |
| 176 | 84 | 17 | 45 | 0 | 0 | 0 | 0.143 |
| 177 | 84 | 17 | 45 | 30 | 0 | 0 | 0.143 |
| 178 | 84 | 17 | 45 | 60 | 0 | 0 | 0.143 |
| 179 | 84 | 17 | 45 | 90 | 0 | 0 | 0.143 |
| 180 | 84 | 17 | 45 | 120 | 0 | 0 | 0.143 |
| 181 | 84 | 17 | 45 | 150 | 0 | 0 | 0.143 |
| 182 | 84 | 17 | 45 | 180 | 0 | 0 | 0.143 |
| 183 | 84 | 17 | 45 | 210 | 0 | 0 | 0.143 |
| 184 | 84 | 17 | 45 | 240 | 0 | 0 | 0.143 |
| 185 | 84 | 17 | 45 | 270 | 0 | 0 | 0.143 |
| 186 | 84 | 17 | 45 | 300 | 0 | 0 | 0.143 |
| 187 | 84 | 17 | 45 | 330 | 0 | 0 | 0.143 |
| 188 | 84 | 19 | 45 | 10 | 17 | 30 | 0.143 |
| 189 | 84 | 19 | 45 | 49 | 42 | 30 | 0.143 |
| 190 | 84 | 19 | 45 | 70 | 17 | 30 | 0.143 |
| 191 | 84 | 19 | 45 | 109 | 42 | 30 | 0.143 |
| 192 | 84 | 19 | 45 | 130 | 17 | 30 | 0.143 |
| 193 | 84 | 19 | 45 | 169 | 42 | 30 | 0.143 |
| 194 | 84 | 19 | 45 | 190 | 17 | 30 | 0.143 |
| 195 | 84 | 19 | 45 | 229 | 42 | 30 | 0.143 |
| 196 | 84 | 19 | 45 | 250 | 17 | 30 | 0.143 |
| 197 | 84 | 19 | 45 | 289 | 42 | 30 | 0.143 |
| 198 | 84 | 19 | 45 | 310 | 17 | 30 | 0.143 |
| 199 | 84 | 19 | 45 | 349 | 42 | 30 | 0.143 |
| 200 | 85 | 1 | 15 | 20 | 9 | 30 | 0.143 |
| 201 | 85 | 1 | 15 | 39 | 50 | 30 | 0.143 |
| 202 | 85 | 1 | 15 | 80 | 9 | 30 | 0.143 |
| 203 | 85 | 1 | 15 | 99 | 50 | 30 | 0.143 |
| 204 | 85 | 1 | 15 | 140 | 9 | 30 | 0.143 |
| 205 | 85 | 1 | 15 | 159 | 50 | 30 | 0.143 |
| 206 | 85 | 1 | 15 | 200 | 9 | 30 | 0.143 |
| 207 | 85 | 1 | 15 | 219 | 50 | 30 | 0.143 |
| 208 | 85 | 1 | 15 | 260 | 9 | 30 | 0.143 |
| 209 | 85 | 1 | 15 | 279 | 50 | 30 | 0.143 |
| 210 | 85 | 1 | 15 | 320 | 9 | 30 | 0.143 |
| 211 | 85 | 1 | 15 | 339 | 50 | 30 | 0.143 |

In addition to the advantages discussed above, there is easier access to the ball with the club in both the fairway and rough because of the ball's size. This easier access allows for cleaner hits. Further, the increased size and moment results in the ball's ability to hold the line during putting. Thus, by increasing the percentage of dimple coverage of the surface of the ball, the ball has the advantages attributable to the larger ball while having enhanced flight characteristics as compared to previous balls having enlarged diameters.

The particular core and cover combination of the present invention provide an improved ball for use by golfers having a slower club head speed.

The above description and drawings are illustrative only since obvious modifications could be made without departing from the invention, the scope of which is to be limited only by the following claims.

We claim:

1. A golf ball of improved playing characteristics comprising a ball having a core and a cover and a mean outside diameter of at least 1.70 inches;

said ball weighing no more than substantially 1.62 ounces;

a dimple pattern comprising a plurality of dimples on the surface of said ball, said dimple pattern covering at least 70.0% of the surface of said ball;

said golf ball having a P.G.A. compression of 80 or less.

2. The golf ball of claim 1 wherein said ball has a P.G.A. compression of 69 to 79.

3. The golf ball of claim 2 wherein the coefficient of restitution of said ball is from 0.780 to 0.825.

4. The golf ball of claim 1 wherein the coefficient of restitution is substantially 0.80.

5. The golf ball of claim 1 wherein said core has a P.G.A. compression of 47 to 57, said cover has a Shore D hardness of 60 to 65, and said ball has a P.G.A. compression of 69 to 79.

6. The golf ball of claim 3 wherein the coefficient of restitution of said ball is from 0.780 to 0.825.

7. The golf ball of claim 3 wherein the coefficient of restitution of said ball is substantially 0.80.

8. The golf ball of claim 1 wherein said core has a P.G.A. compression of substantially 52, said cover has a Shore D hardness of substantially 62, and said ball has a P.G.A. compression of 69 to 79.

9. The golf ball of claim 1 wherein the coefficient of restitution of said ball is from 0.780 to 0.825.

10. The golf ball of claim 1 wherein the coefficient of restitution of said ball is substantially 0.80, 9, The golf ball of claim 2 wherein the coefficient of restitution is substantially 0.80.

* * * * *